US009027797B2

(12) United States Patent
Mann et al.

(10) Patent No.: US 9,027,797 B2
(45) Date of Patent: May 12, 2015

(54) SHIELD FOR A FLUID DISPENSER

(71) Applicants: Christopher J. Mann, Cuyahoga Falls, OH (US); Shelby Jay Buell, Medina, OH (US); Touby Khamphilapanyo, Garfield Heights, OH (US); Robert L. Quinlan, Stow, OH (US); Richard E. Corney, Akron, OH (US)

(72) Inventors: Christopher J. Mann, Cuyahoga Falls, OH (US); Shelby Jay Buell, Medina, OH (US); Touby Khamphilapanyo, Garfield Heights, OH (US); Robert L. Quinlan, Stow, OH (US); Richard E. Corney, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 13/804,821

(22) Filed: Mar. 14, 2013

(65) Prior Publication Data

US 2014/0203045 A1 Jul. 24, 2014

Related U.S. Application Data

(60) Provisional application No. 61/755,961, filed on Jan. 23, 2013.

(51) Int. Cl.
*G01F 11/00* (2006.01)
*A47K 5/12* (2006.01)

(52) U.S. Cl.
CPC ..... *A47K 5/1211* (2013.01)

(58) Field of Classification Search
USPC ..... 222/181.3, 129.1, 137, 140, 142.9, 222/153.1, 153.09, 180, 182, 207, 321.8, 222/461–462, 504–505, 567–570, 609, 63, 222/566, 181.1
See application file for complete search history.

(56) References Cited

U.S. PATENT DOCUMENTS

| | | | | |
|---|---|---|---|---|
| 2,075,782 | A | 3/1937 | Mackay | |
| 3,327,901 | A * | 6/1967 | Yerkovich | 222/52 |
| 4,218,014 | A * | 8/1980 | Tracy | 239/106 |
| 4,932,564 | A * | 6/1990 | Austin et al. | 222/129.1 |
| 6,082,586 | A * | 7/2000 | Banks | 222/95 |
| 6,929,193 | B2 | 8/2005 | Ruddy | |
| D539,145 | S | 3/2007 | Carlson et al. | |
| 7,225,948 | B2 * | 6/2007 | Ophardt et al. | 222/181.3 |
| D593,784 | S | 6/2009 | Chan | |
| D601,422 | S | 10/2009 | Benavidez et al. | |
| 7,621,426 | B2 * | 11/2009 | Reynolds et al. | 222/325 |
| 7,798,370 | B2 | 9/2010 | Ciavarella et al. | |
| 7,850,049 | B2 | 12/2010 | Ciavarella et al. | |
| 7,950,548 | B2 | 5/2011 | Ciavarella et al. | |
| D642,917 | S | 8/2011 | Mills | |
| D643,304 | S | 8/2011 | Mills | |
| 8,047,403 | B2 | 11/2011 | Quinlan et al. | |
| 8,047,404 | B2 | 11/2011 | Quinlan et al. | |
| 8,091,739 | B2 * | 1/2012 | Ophardt et al. | 222/181.3 |
| D653,482 | S | 2/2012 | Ciavarella et al. | |
| D657,672 | S | 4/2012 | Mills | |

(Continued)

OTHER PUBLICATIONS

Young, Lee W.; International Search Report and Written Opinion of the International Searching Authority, issued in International Application No. PCT/US2014/012315; dated as mailed on May 16, 2014; 16 pages.

*Primary Examiner* — Frederick C Nicolas
*Assistant Examiner* — Bob Zadeh
(74) *Attorney, Agent, or Firm* — Ulmer & Berne LLP

(57) ABSTRACT

A shield for a fluid dispenser includes a mount structure and a fluid-deflecting structure defining an interior flow passage. The mount structure is configured to be attached to an actuator of a fluid dispenser. Fluid dispensers and fluid dispenser systems are also disclosed.

24 Claims, 18 Drawing Sheets

(56) References Cited

U.S. PATENT DOCUMENTS

| | | | | |
|---|---|---|---|---|
| D658,496 | S | 5/2012 | Mills | |
| D665,610 | S | 8/2012 | Kanfer et al. | |
| 8,261,941 | B2 * | 9/2012 | Woo et al. | 222/52 |
| 8,261,942 | B2 * | 9/2012 | Chen | 222/63 |
| 8,261,950 | B2 * | 9/2012 | Cittadino et al. | 222/321.7 |
| 8,267,284 | B2 | 9/2012 | Ray | |
| 8,276,784 | B2 | 10/2012 | Ciavarella et al. | |
| 8,313,008 | B2 | 11/2012 | Ciavarella et al. | |
| 8,313,010 | B2 | 11/2012 | Quinlan et al. | |
| 8,365,965 | B2 * | 2/2013 | Ophardt | 222/321.8 |
| 8,602,263 | B2 * | 12/2013 | Baron et al. | 222/153.13 |
| 2003/0075565 | A1 * | 4/2003 | Gerenraich et al. | 222/207 |
| 2007/0210110 | A1 | 9/2007 | Anhuf et al. | |
| 2008/0245314 | A1 * | 10/2008 | Brodowski et al. | 119/651 |
| 2009/0101671 | A1 * | 4/2009 | Cittadino et al. | 222/23 |
| 2009/0108023 | A1 | 4/2009 | Houghton et al. | |
| 2009/0308894 | A1 * | 12/2009 | Ophardt | 222/190 |
| 2012/0168466 | A1 | 7/2012 | Mills | |
| 2012/0325857 | A1 * | 12/2012 | Ophardt et al. | 222/181.3 |
| 2012/0325863 | A1 | 12/2012 | Houghton et al. | |
| 2013/0105519 | A1 * | 5/2013 | Sundberg et al. | 222/153.13 |

* cited by examiner

SHIELD FOR A FLUID DISPENSER

CROSS REFERENCE TO RELATED APPLICATION

This application claims the priority benefit of U.S. Provisional Patent Application Ser. No. 61/755,961, "Shield For A Fluid Dispenser", filed Jan. 23, 2013, which is hereby expressly incorporated by reference herein in its entirety.

TECHNICAL FIELD

The present disclosure relates generally to fluid dispensers and more particularly, to shields for fluid dispensers.

BACKGROUND

Manually operated and "touch-free" fluid dispensers are known that dispense solutions of various types, such as hand sanitizers and soaps, in various forms including gel-like fluids and foams.

SUMMARY

According to one embodiment, a shield for a fluid dispenser includes a mount structure and a fluid-deflecting structure. The fluid-deflecting structure defines an interior flow passage having an inlet opening and a discharge opening. The discharge opening is smaller than the inlet opening and is spaced distally from the mount structure. The fluid-deflecting structure includes a frustoconical portion that defines the discharge opening of the interior flow passage. The mount structure and the fluid-deflecting structure are integrally formed from a polymeric material as a unitary structure. The mount structure is configured for releasable attachment to an actuator of a fluid dispenser.

According to another embodiment, a fluid dispenser includes a housing that is configured to support a fluid container. The fluid dispenser also includes an actuator and a shield. The actuator is movable with respect to the housing. The shield includes a mount structure and a fluid-deflecting structure that defines an interior flow passage having an inlet opening and a discharge opening. The discharge opening is smaller than the inlet opening and is spaced distally from the mount structure. The mount structure is attached to the actuator such that the shield is movable with the actuator.

According to another embodiment, a fluid dispenser system includes a fluid dispenser and a fluid container assembly. The fluid dispenser includes a housing, an actuator, and a shield. The actuator is movable with respect to the housing and the shield is coupled with the housing. The fluid container assembly includes a fluid container that is supported by the housing and is configured to contain a fluid for dispensing therefrom. The fluid container assembly further includes a pump that includes a nozzle. The nozzle defines a nozzle flow passage and includes a distal end portion that defines a discharge orifice. The discharge orifice is in fluid communication with the flow passage. The actuator selectively, operably actuates the pump. The shield at least partially defines an interior flow passage. The distal end portion of the nozzle is positioned at least partially within the interior flow passage defined by the shield. The discharge orifice defined by the distal end portion of the nozzle is in fluid communication with the interior flow passage defined by the shield.

BRIEF DESCRIPTION OF THE DRAWINGS

It is believed that certain embodiments will be better understood from the following description taken in conjunction with the accompanying drawings in which.

DETAILED DESCRIPTION

Figure 1:
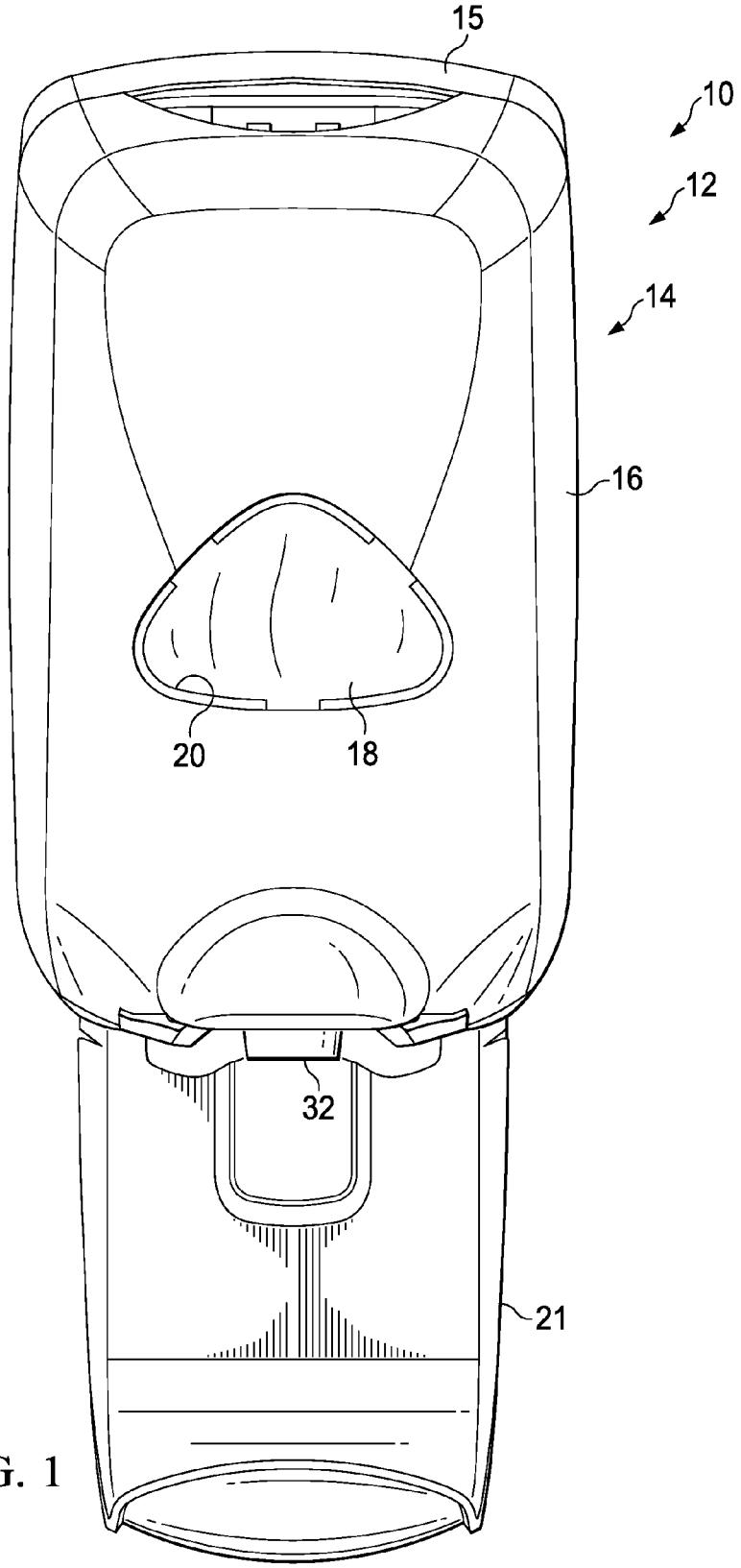
FIG. 1 is front elevational view depicting a fluid dispenser of a fluid dispenser system and a portion of a fluid container of a fluid container assembly of the fluid dispenser system, and further depicting a drip tray of the fluid dispenser attached to a base of the fluid dispenser, and a portion of a shield of the fluid dispenser, according to one embodiment.
Figure 2:
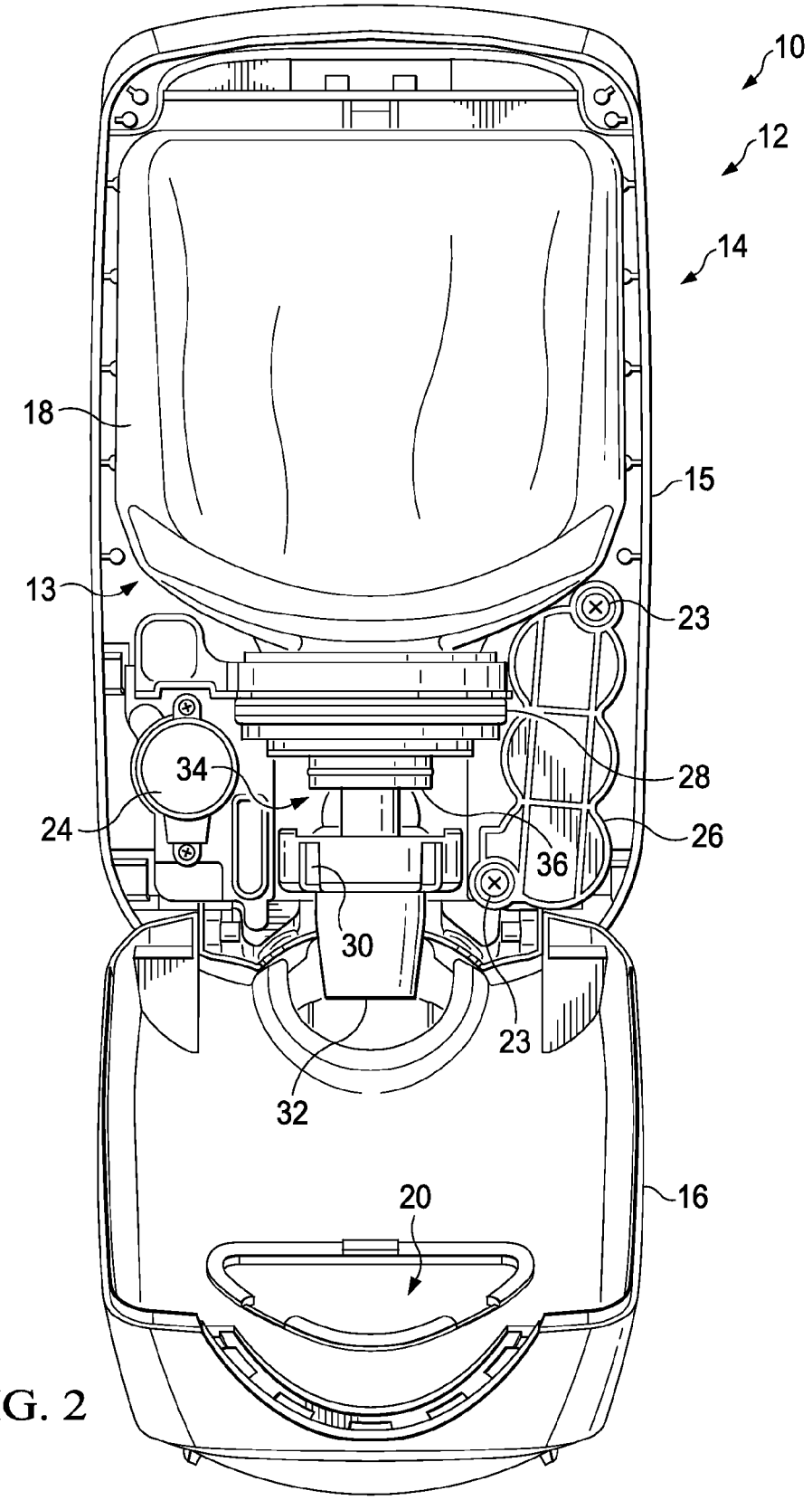
FIG. 2 is a front elevational view of the fluid dispenser system of FIG. 1, but with the drip tray omitted and with a lid of the fluid dispenser shown in an open position, and depicting the fluid container assembly.
Figure 6:
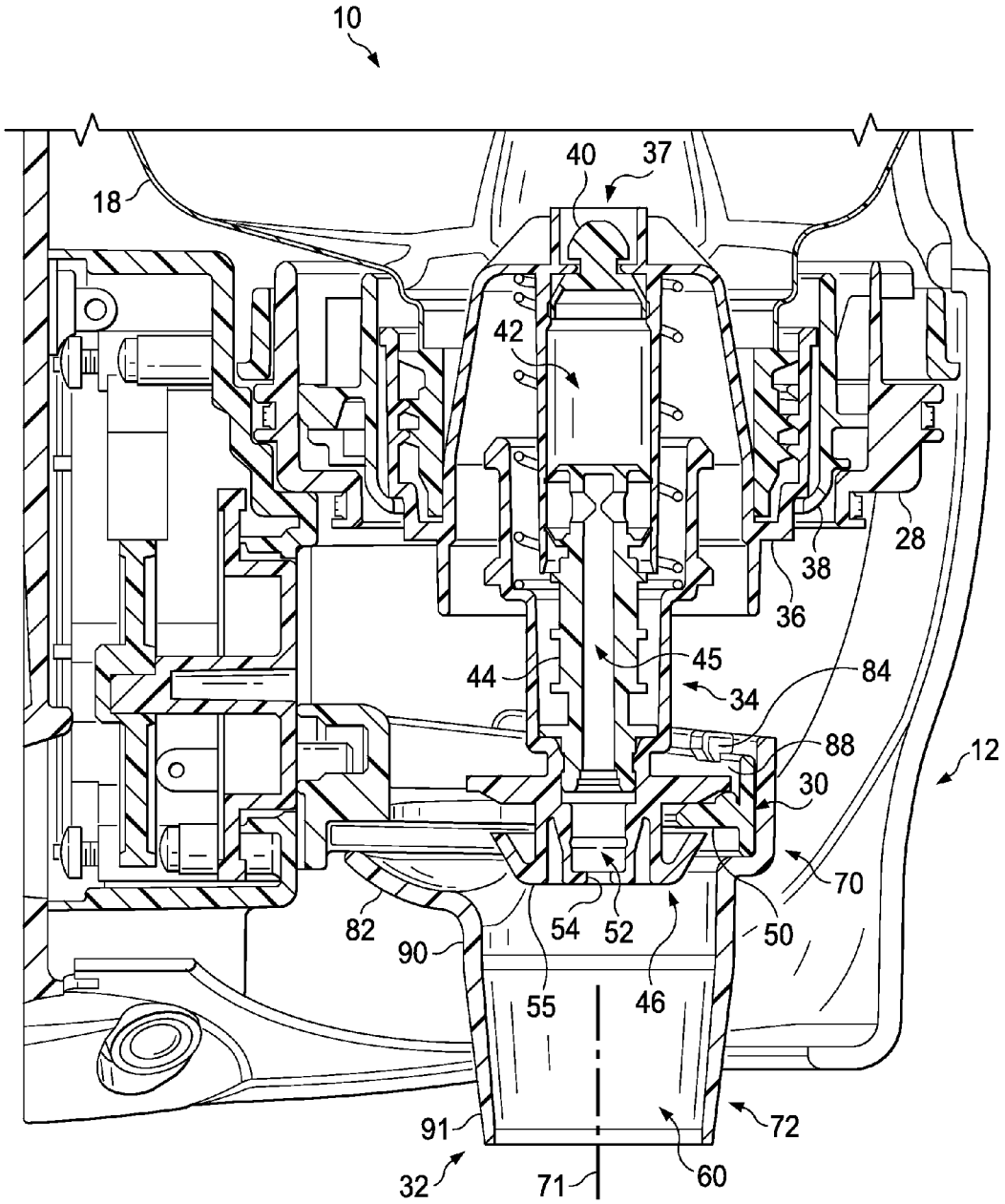
FIG. 6 is a cross-sectional view of a portion of the fluid dispenser system of FIG. 1.
Figure 7:
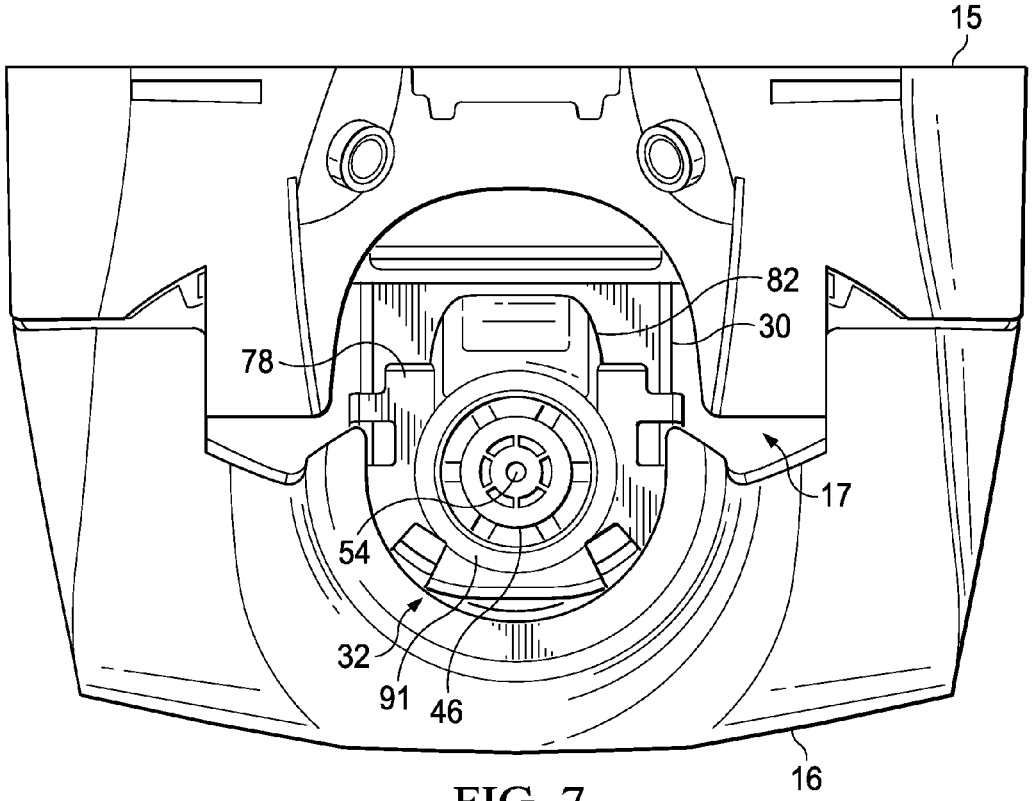
FIG. 7 is a bottom end elevational view of the fluid dispenser system of FIG. 1.
Figure 8:
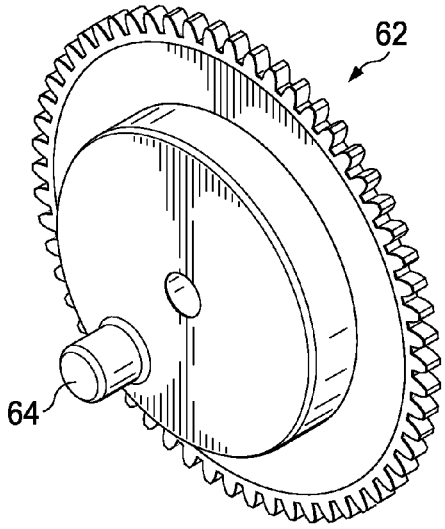
FIG. 8 is a perspective view of a cam gear of the fluid dispenser of FIG. 1.

Certain embodiments are described herein in connection with the views and examples of FIGS. 1-26, wherein like numbers indicate the same or corresponding elements throughout the views. FIGS. 1 and 2 illustrate a fluid dispenser system 10, which can include a fluid dispenser 12 and a fluid container assembly 13. The fluid dispenser 12 can include a housing 14, which can include a base 15 and a lid 16. The lid 16 can be pivotally coupled with the base 15, for example, with one or more hinges. The lid 16 can be pivotable between an open position (FIGS. 2 and 3) and a closed position (FIGS. 1 and 7). While the lid 16 is shown to be pivotally coupled with the base 15 on a bottom edge of the base 15, it will be appreciated that such coupling could occur along any edge of the base 15. Referring to FIG. 7, the base 15 and the lid 16 can cooperate to define an interior chamber 17 when the lid 16 is in the closed position. Various components of the fluid dispenser 12, and the fluid container assembly 13, can be positioned, or housed, within the interior chamber 17. For example, the housing 14 can be configured to receive a fluid container, or fluid refill, for example a fluid container 18 of the fluid container assembly 13, within the interior chamber 17. The fluid container 18 can contain a liquid, for example, a liquid gel, to be dispensed from the fluid dispenser system 10, for example onto the hands of a user.

The fluid dispenser 12 is shown to be a wall-mounted type of fluid dispenser. The base 15 can define a plurality of apertures, for example apertures 19 shown in FIG. 3, which can facilitate attaching the fluid dispenser 12 to a wall or other structure. For example, each of the apertures 19 can be configured to receive a respective male fastener (not shown). Such male fasteners can be used to attach the base 15 to a wall (not shown) or other structure, for example by attaching each male fastener to a respective female fastener (not shown) embedded in a wall or other structure.

Figure 3:
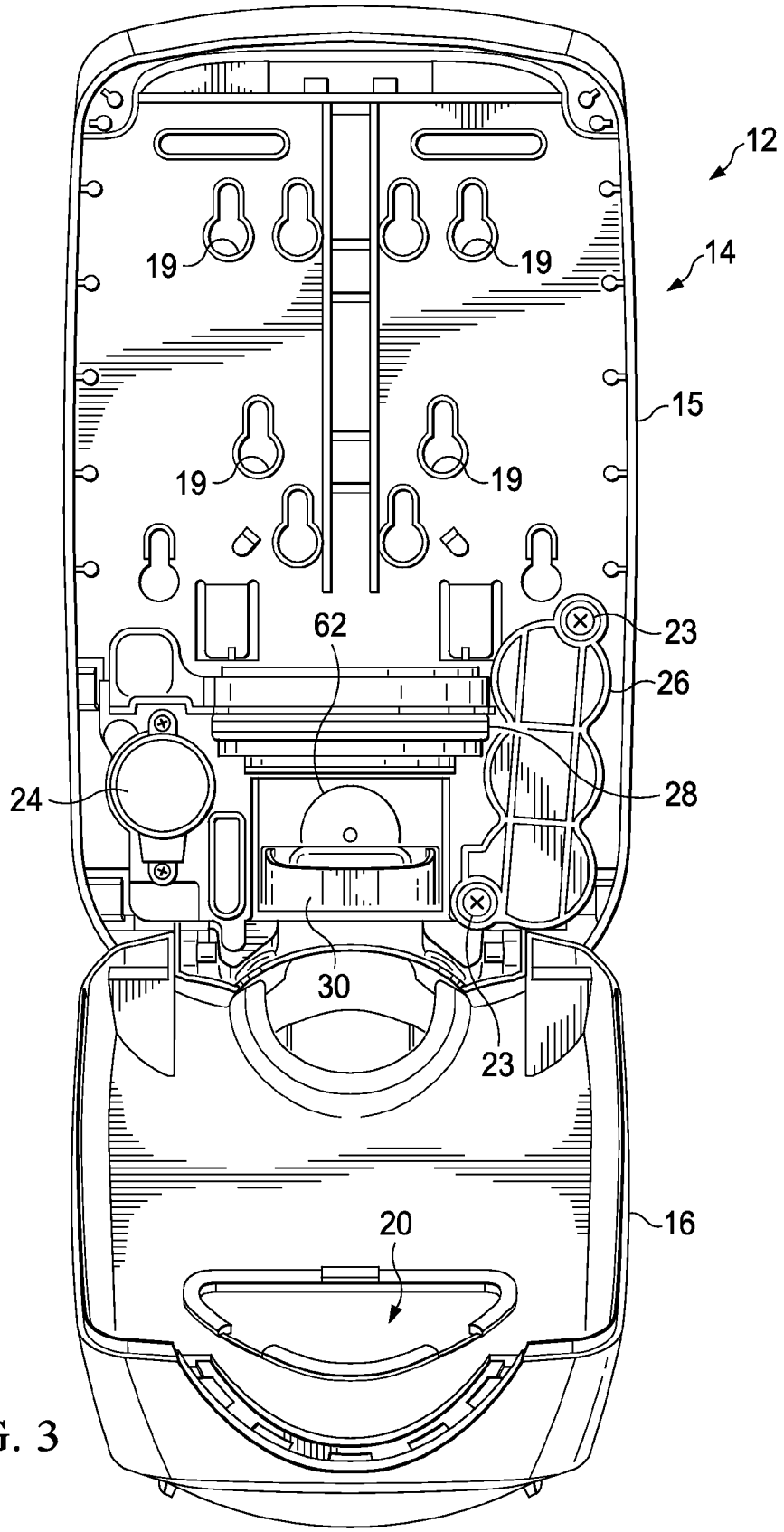
FIG. 3 is a front elevational view similar to FIG. 2, but with the fluid container assembly and the shield of the fluid dispenser omitted.
Figure 4:
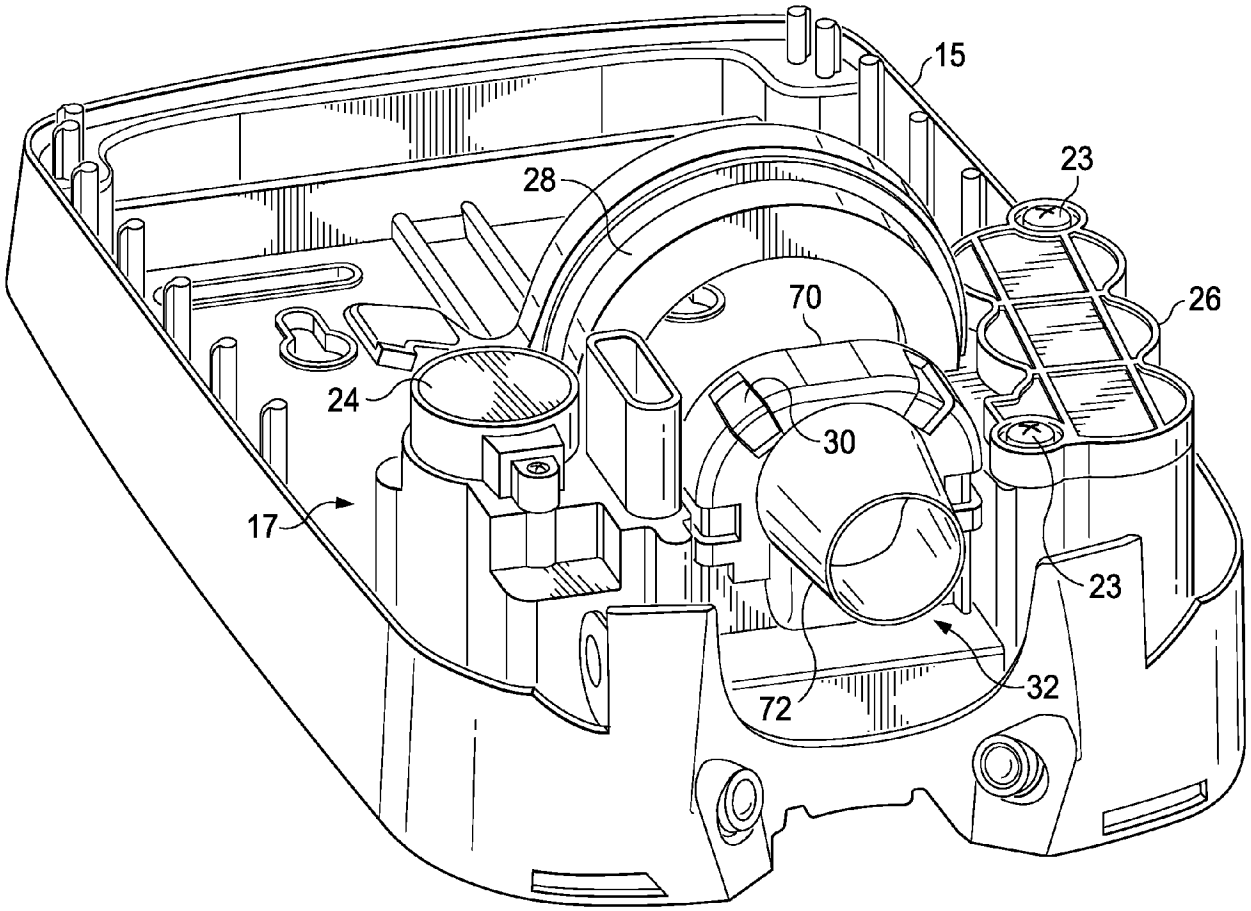
FIG. 4 is a perspective view of a base of the fluid dispenser of FIG. 1, in association with other components of the fluid dispenser, which are supported by the base.

As shown in FIGS. 1-3, the lid 16 can include a one or more apertures 20, or windows, which can facilitate looking into the interior chamber 17 defined by the base 15 and lid 16, for example, to determine if a fluid container, or a fluid refill such as the fluid container 18, is disposed within the interior chamber 17. FIG. 1 illustrates the fluid dispenser 12 with the lid 16 in a closed position. As shown in FIG. 1, a portion of the fluid container 18 can be seen through one of the apertures 20. FIGS. 2 and 3 each illustrate the lid 16 in an open position. The fluid container assembly 13 is shown in FIG. 2, but is omitted in FIG. 3.

The fluid dispenser 12 can also include a drip tray 21 (FIG. 1), which can be attached to the base 15 and can extend downwardly from the base 15. During operation of the fluid dispenser system 10, a liquid, such as a liquid gel, that is dispensed from a fluid container or fluid refill, (e.g., fluid container 18), but not contained by a user's hands, may be captured by the drip tray 21 to avoid spillage onto a floor or other surface of a facility in which the fluid dispenser system 10 is used.

Figure 5:
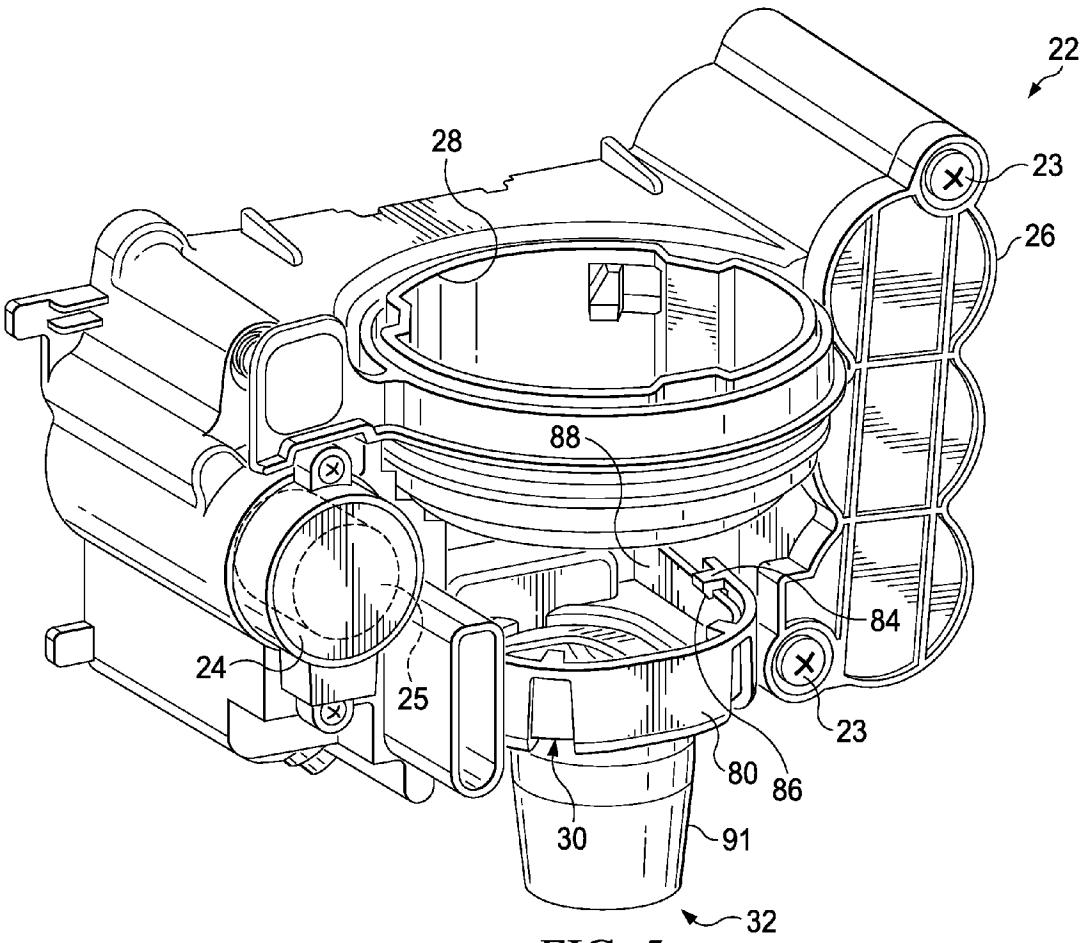
FIG. 5 is a perspective view of a pump house module of the fluid dispenser of FIG. 1.

FIG. 5 illustrates a pump house module 22, which can be positioned within the interior chamber 17, and can be attached to the base 15 with a plurality of fasteners, for example male fasteners 23. The pump house module 22 can include a motor housing 24 and a motor 25, housed within the motor housing 24. The pump house module 22 can also include a battery housing 26. A plurality of batteries (not shown) can be positioned within the battery housing 26 and can be electrically coupled with the motor 25. The pump house module 22 can also include a collar lock assembly 28, which can be coupled with the fluid container assembly 13.

The pump house module 22 can also include an actuator 30 and a shield 32 according to one embodiment. The actuator 30 can be movably coupled with the housing 14. The shield 32 can also be movably coupled with the housing 14, for example, by attaching the shield 32 to the actuator 30, as subsequently described with reference to FIGS. 5-7 and 9-14. The actuator 30 and the shield 32 can be movable, upwardly and downwardly, with respect to the housing 14.

After a cap (not shown) has been removed, the fluid container assembly 13 can be positioned within the interior chamber 17 and releasably secured to the fluid dispenser 12. The fluid container assembly 13 can include a pump 34 (FIGS. 2 and 6). The pump 34 can include a closure 36 that can be threaded onto a neck of the fluid container 18. The closure 36 can define an inlet port 37, which can be in fluid communication with an interior fluid chamber (not shown) defined by the fluid container 18. The fluid container assembly 13 can also include a collar 38, which can engage the pump 34 in a snap-fit. The fluid container assembly 13 can be releasably secured to the fluid dispenser 12 by releasably securing the collar 38 of the fluid container assembly 13 to the collar lock assembly 28 of fluid dispenser 12. The collar 38 can engage the collar lock assembly 28 in a snap-fit arrangement.

The pump 34 can also include an intake valve 40. An upper portion of the intake valve 40 can be positioned within the inlet port 37, and a lower portion of the intake valve 40 can be positioned within a piston chamber 42 (FIG. 6) that can be defined by the closure 36. The pump 34 can also include a reciprocating piston 44, which can be movable upwardly and downwardly within the piston chamber 42. The reciprocating piston 44 can define an interior flow passage 45, which can be in fluid communication with the piston chamber 42.

The pump 34 can include a nozzle 46 (FIG. 6), which can be secured to the actuator 30 of the fluid dispenser 12. In one embodiment, a portion of the nozzle 46 can extend through an opening 48 (FIGS. 9 and 10) defined by the actuator 30, such that a base 50 of the actuator 30 can be positioned between upper and lower portions of the nozzle 46, for example as shown in FIG. 6, to secure the nozzle 46 to the actuator 30. The nozzle 46 can define a nozzle flow passage 52 (FIG. 6), which can be in fluid communication with the interior flow passage 45 defined by the reciprocating piston 44. The nozzle 46 can also define a discharge orifice 54, which can be in fluid communication with the nozzle flow passage 52. The nozzle 46 can include a distal end portion 55, which can define the discharge orifice 54. As shown in FIG. 6, the shield 32 can define an interior flow passage 60. The distal end portion 55 of the nozzle 46 can be positioned within the interior flow passage 60, such that the discharge orifice 54 is in fluid communication with the interior flow passage 60 as shown in FIG. 6.

The motor 25 can provide motive power to operate the pump 34. For example, in one embodiment, an output of the motor 25 can be rotatably coupled with a cam gear 62 (FIG. 8) of the fluid dispenser 12 via a drivetrain. The cam gear 62 can include a pin 64, which can be offset from a center of rotation of the cam gear 62. The pin 64 can be positioned within a slot 66 (FIG. 10) defined by the actuator 30. As a result, when the cam gear 62 rotates, the pin 64 can force the actuator 30 to move upwardly and downwardly, due to the offset nature of the pin 64. Movement of the actuator 30 can cause the reciprocating piston 44 of pump 34 to move upwardly and downwardly within the piston chamber 42. Additionally, due to the attachment of each of the nozzle 46 of the pump 34 of the fluid container assembly 13 and the shield 32 of the fluid dispenser 12 to the actuator 30, each of the nozzle 46 and the shield 32 can move with the actuator 30, which can be upwardly and downwardly when the fluid dispenser 12 is mounted to a wall and is generally vertically oriented.

Figure 13:
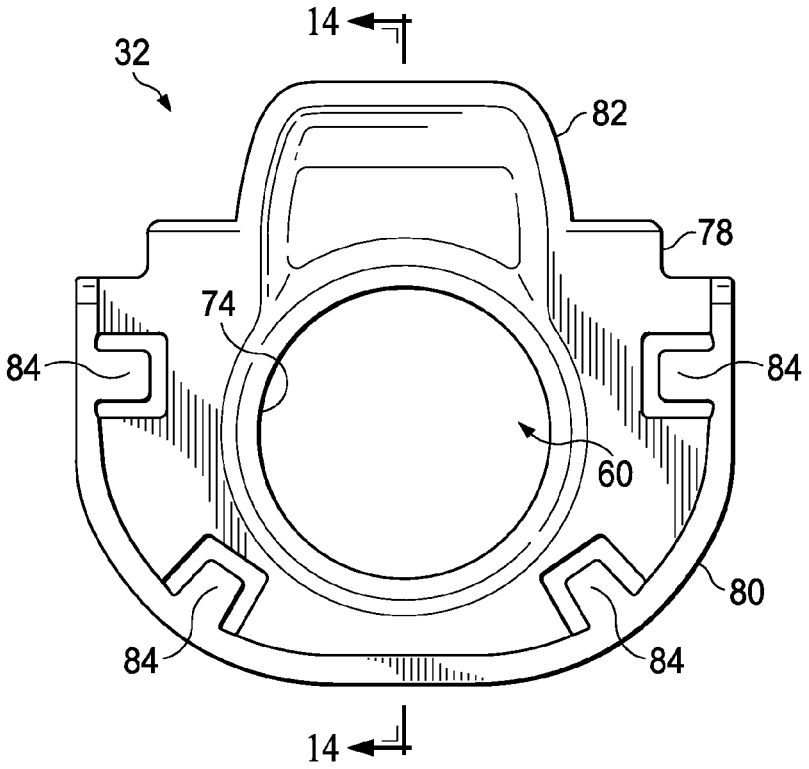
FIG. 13 is a top plan view of the shield of the fluid dispenser of FIG. 1.
Figure 14:
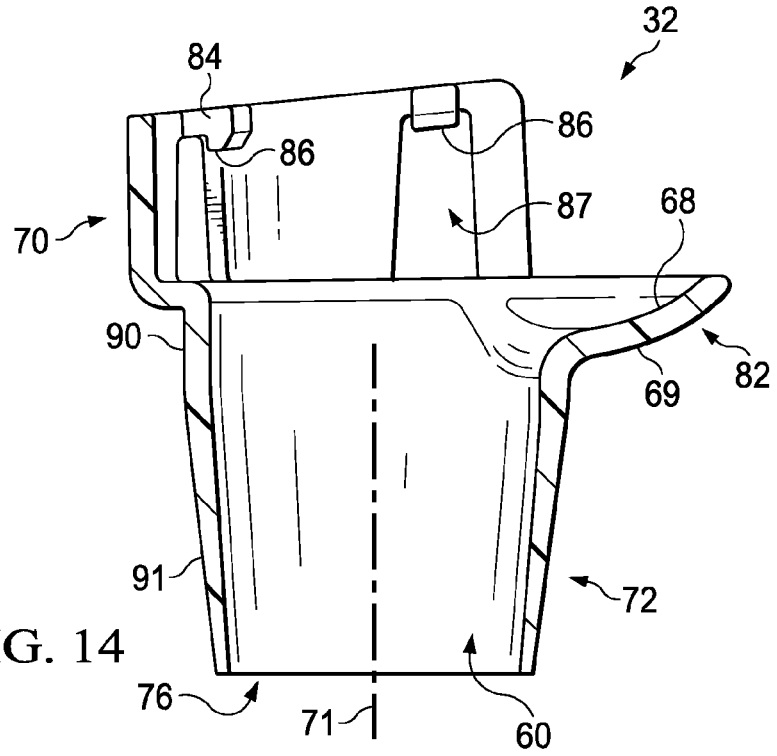
FIG. 14 is a cross-sectional view of the shield of the fluid dispenser of FIG. 1.

Referring to FIGS. 11-14, the shield 32 can include a mount structure 70 and a fluid-deflecting structure 72, which can define the interior flow passage 60 of the shield 32. The interior flow passage 60 can have an inlet opening 74 (FIG. 13) and a discharge opening 76 (FIG. 14). In one embodiment, the mount structure 70 and the fluid-deflecting structure 72 of shield 32 can be integrally formed as a unitary structure. In one embodiment, the mount structure 70 and the fluid-deflecting structure 72 can be integrally formed from any suitable polymeric material, using any suitable molding process.

The mount structure 70 can include a base flange 78 and a perimeter flange 80. The base flange 78 can extend outwardly from the fluid-deflecting structure 72. The perimeter flange 80 can be integral with the base flange 78 and can extend around at least a portion of the base flange 78, which can be a substantial portion, as shown in FIGS. 11-14. The shield 32 can also include a scoop 82, which can be integral with each of the base flange 78 of the mount structure 70 and the fluid-deflecting structure 72, and can generally extend outwardly away from each of the base flange 78 and the fluid-deflecting structure 72. The scoop 82 can include an inner surface 68 and an outer surface 69. The inner surface 68 can be generally concave, and the outer surface 69 can be generally convex, as viewed in cross-section, as shown in FIG. 14. The scoop 82 can facilitate installation of the fluid container assembly 13, for example, by at least reducing the possibility of an interference between shield 32 and pump 34 as the fluid container assembly 13 is releasably secured to the fluid dispenser 12.

The base flange 78 of the mount structure 70 can surround at least a portion of the inlet opening 74 of the interior flow passage 60 defined by the fluid-deflecting structure 72, as shown in FIG. 13. The perimeter flange 80 of the mount structure 70 can be transverse to the base flange 78 of the mount structure 70, and can generally extend longitudinally, and proximally, away from the base flange 78. The mount structure 70 can further include a plurality of circumferentially spaced mount arms 84. The mount arms 84 can be integral with the perimeter flange 80, and can extend inwardly from the perimeter flange 80. Each of the mount arms 84 of the mount structure 70 can include a distal tab 86. The base flange 78 and the perimeter flange 80 of the mount structure 70 can cooperate to define a plurality of generally circumferentially spaced apertures 87, which can reduce the complexity of a mold (not shown) that can be used to form the shield 32, and can accordingly reduce tooling cost and cycle time for the manufacture of the shield 32. In one embodiment, each of the mount arms 84 can be aligned with a respective one of the apertures 87.

Figure 9:
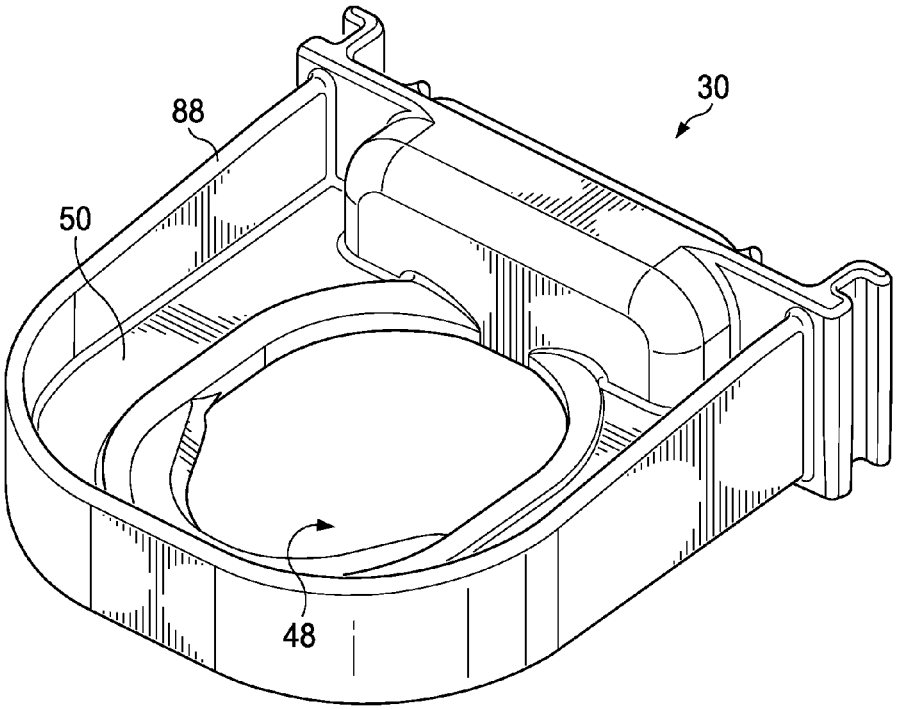
FIG. 9 is a top perspective view of an actuator of the fluid dispenser of FIG. 1.
Figure 10:
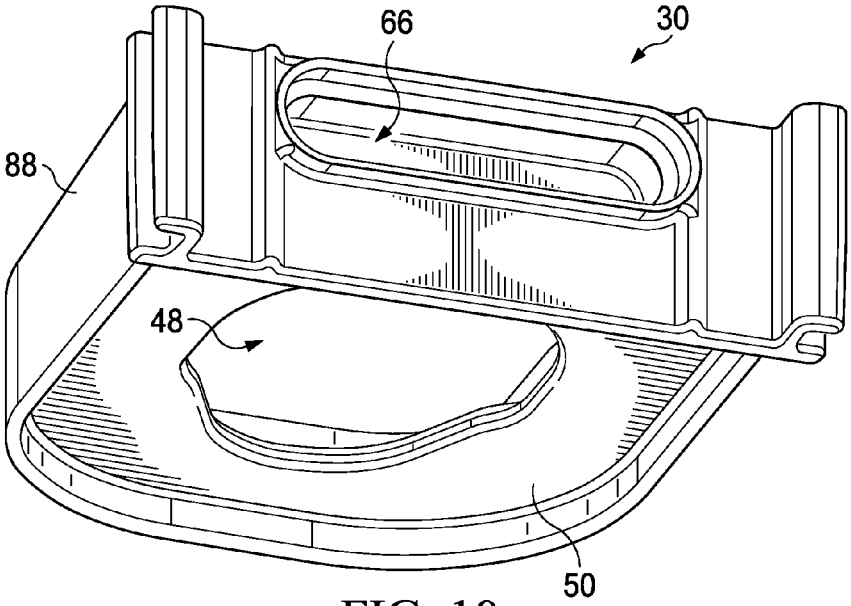
FIG. 10 is a bottom perspective view of the actuator depicted in FIG. 9.
Figure 11:
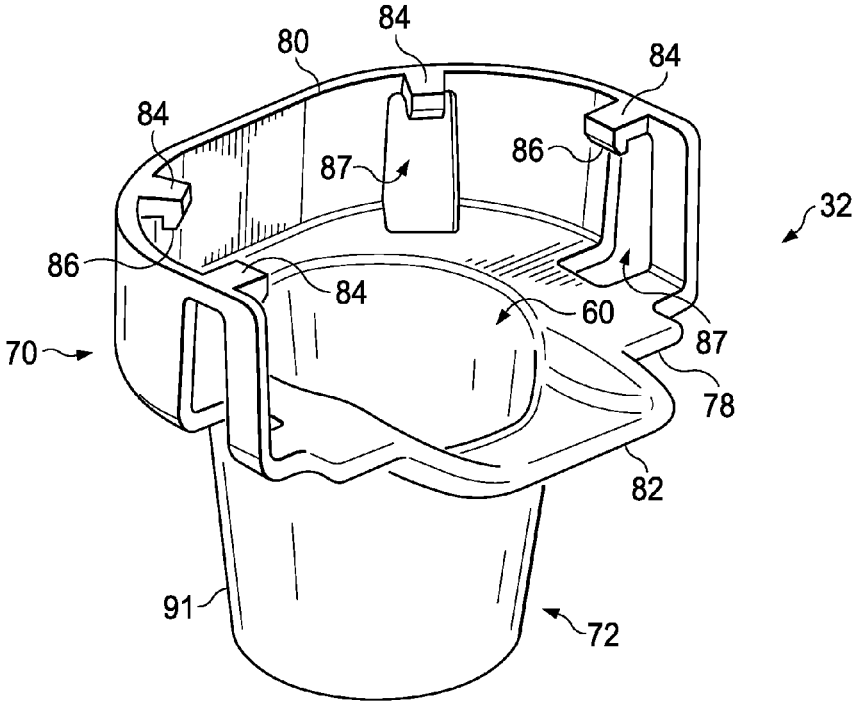
FIG. 11 is a perspective view of the shield of the fluid dispenser of FIG. 1.
Figure 12:
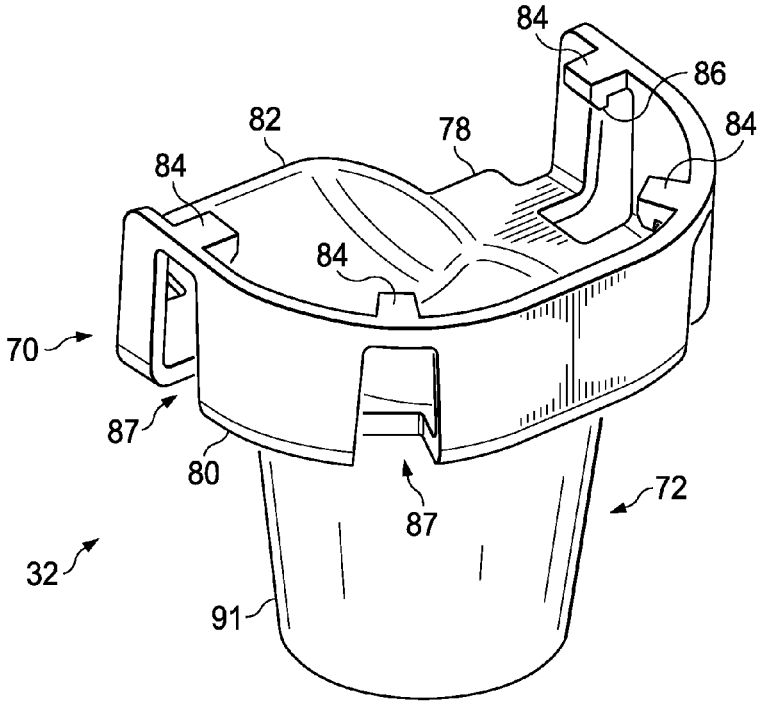
FIG. 12 is another perspective view of the shield of the fluid dispenser of FIG. 11.

The mount arms 84 and the included distal tabs 86, can be used to attach the shield 32 to the actuator 30. The actuator 30 can include a perimeter flange 88, which can be generally U-shaped, as shown in FIG. 9. The distal tabs 86 of the mount arms 84 can be secured to the perimeter flange 88 of the actuator 30, for example as shown in FIG. 5. In one embodiment, the tabs 86 of the mount arms 84 can engage the perimeter flange 88 of the actuator 30 in a snap-fit arrangement.

The fluid-deflecting structure 72 of the shield 32 can generally extend longitudinally, and distally, away from the mount structure 70 of shield 32. The fluid-deflecting structure 72 can include a generally cylindrical portion 90 and a frustoconical portion 91. The generally cylindrical portion 90 of the fluid-deflecting structure 72 can generally extend longitudinally, and distally, away from the mount structure 70 of shield 32. The frustoconical portion 91 of the fluid-deflecting structure 72 can generally extend longitudinally, and distally, away from the generally cylindrical portion 90. The generally cylindrical portion 90 of the fluid-deflecting structure 72 can define the inlet opening 74 of the interior flow passage 60, and the frustoconical portion 91 of the fluid-deflecting structure 72 can define the discharge opening 76 of the interior flow passage 60. As shown in FIG. 14, the frustoconical portion 91 of the fluid-deflecting structure 72 can taper inwardly from the generally cylindrical portion 90 of the fluid-deflecting structure 72. The frustoconical portion 91 of the fluid-deflecting structure 72 can define a longitudinal centerline axis 71.

When the shield 32 is attached to the actuator 30, for example as described previously, the distal end portion 55 of the nozzle 46 of pump 34 can be positioned proximate to, or within, the interior flow passage 60 defined by the shield 32. As a result, the discharge orifice 54 can be in fluid communication with the interior flow passage 60, and a fluid, such as a liquid gel, discharging from the discharge orifice 54 during operation of the fluid dispenser system 10 can discharge into the interior flow passage 60, which can be advantageous as subsequently described. The discharge orifice 54 can be generally centrally aligned with the interior flow passage 60, which can facilitate discharging fluid from the discharge orifice 54 into the interior flow passage 60. In one embodiment, the distal end portion 55 of nozzle 46, which defines the discharge orifice 54, can be coaxially disposed about the longitudinal centerline axis 71 defined by the frustoconical portion 91 of the fluid-deflecting structure 72, and the longitudinal centerline axis 71 can extend through the discharge orifice 54. Referring to FIGS. 6 and 11-14, the fluid-deflecting structure 72 of shield 32 can at least substantially surround the distal end portion 55 of nozzle 46.

Figure 15:
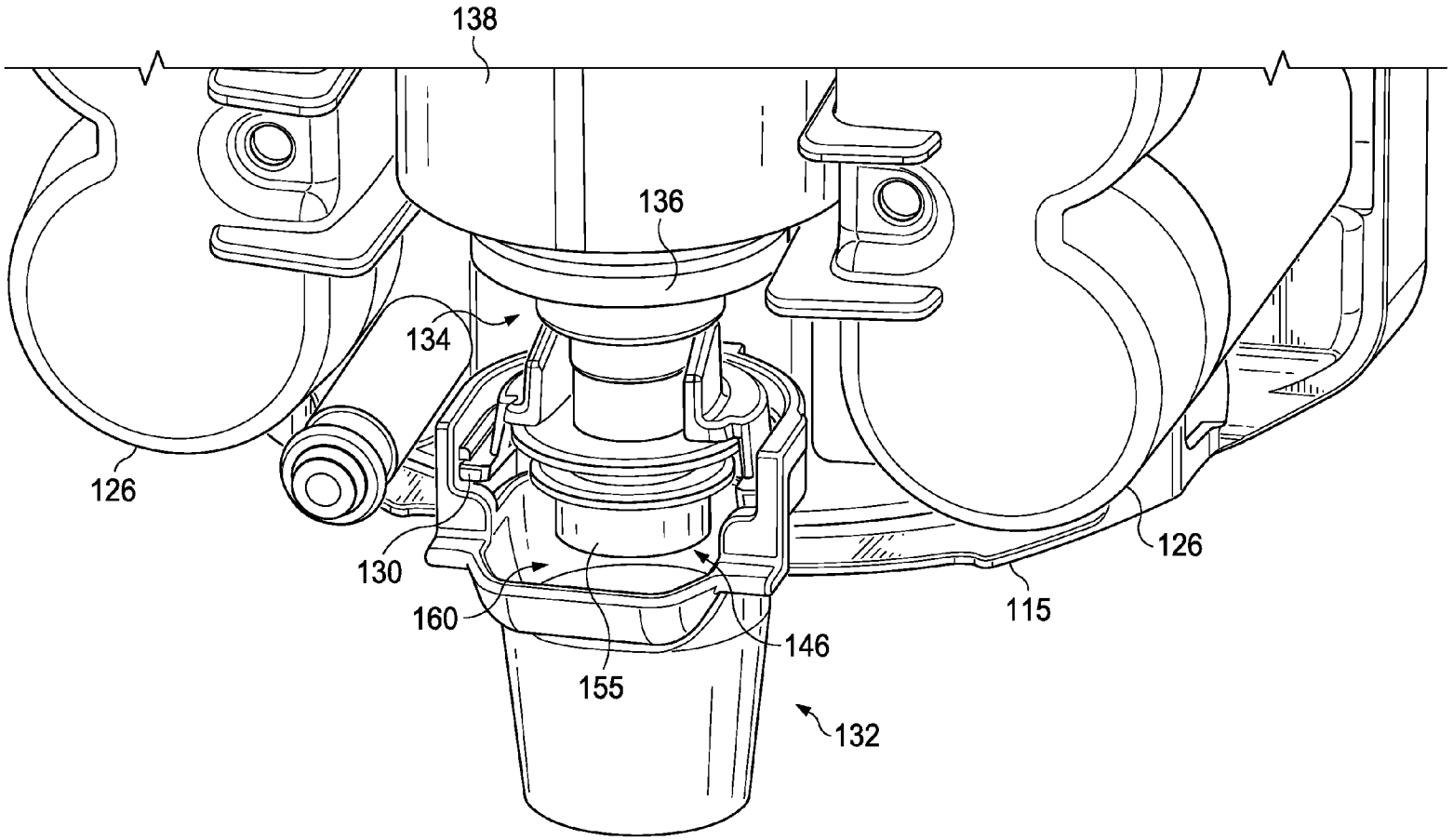
FIG. 15 is a front perspective view of a portion of a fluid dispenser system according to another embodiment, that includes a shield according to another embodiment.
Figure 16:
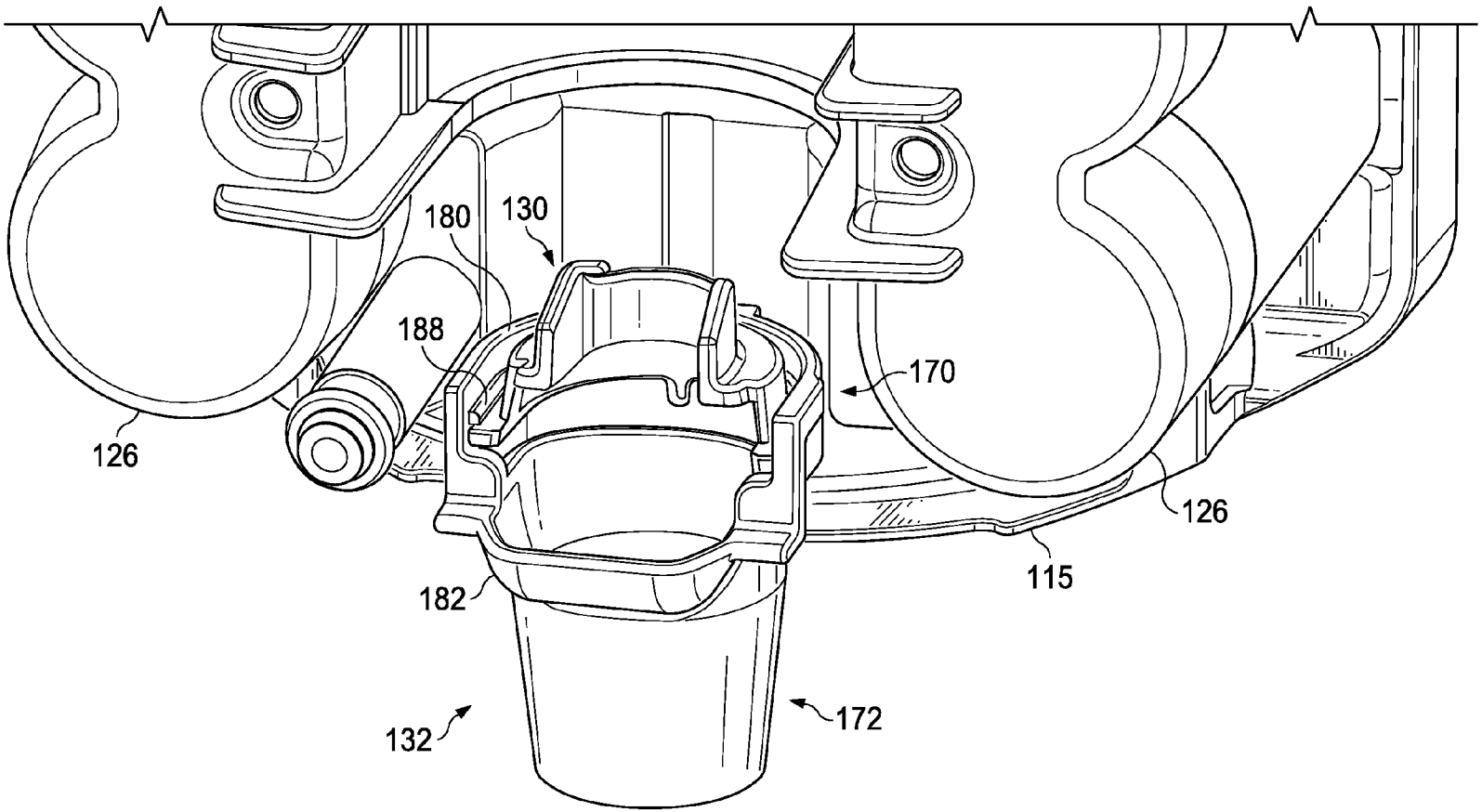
FIG. 16 is a front perspective view similar to FIG. 15, but with a pump of the fluid container assembly of the fluid dispenser system, and certain associated components of the fluid dispenser system, omitted.

FIGS. 15 and 16 illustrate a portion of a fluid container assembly according to another embodiment, which can include a shield 132 according to another embodiment. The fluid container assembly can include a fluid dispenser and a fluid container assembly releasably secured to the fluid dispenser. FIGS. 15 and 16 illustrate a portion of a base 115 of a housing of the fluid dispenser. A lid of the housing of the fluid dispenser is not shown in FIGS. 15 and 16, such that various components of the fluid dispenser within the housing can be seen. For example, the fluid dispenser can include battery housings 126, which can be attached to the base 115 and can contain batteries (not shown) that can be electrically coupled with a motor (not shown). The fluid dispenser can also include an actuator 130 that can be coupled with the motor and can move relative to the base 115, which can be upward and downward movement when the fluid dispenser is mounted to a wall and is generally vertically oriented. The fluid dispenser can also include the shield 132, which can be attached to the actuator 130 as shown in FIGS. 15 and 16, such that the shield 132 can be movable with the actuator 130 and movably coupled with the housing of the fluid dispenser.

FIG. 15 also illustrates a portion of a pump 134 of the fluid container assembly, and a portion of a collar 138 of the fluid container assembly. The collar 138 can be releasably attached to the fluid dispenser to releasably attach the fluid container assembly to the fluid dispenser. The pump 134 can include a closure 136 that can be threaded onto a fluid container, which can be configured to contain a fluid, of the fluid container assembly. The pump 134 can also include a nozzle 146, which can be attached to the actuator 130, such that movement of the actuator 130 causes movement of the pump 134, which in turn causes fluid to be discharged from the fluid container through the nozzle 146. The nozzle 146 can include a distal end portion 155, which can define a discharge orifice (not shown).

Figure 19:
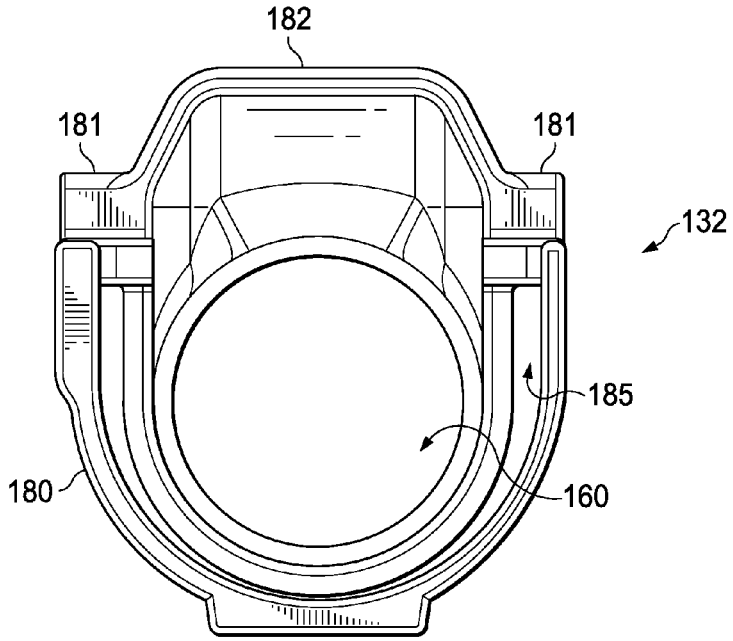
FIG. 19 is a top plan view of the shield of FIG. 17.
Figure 20:
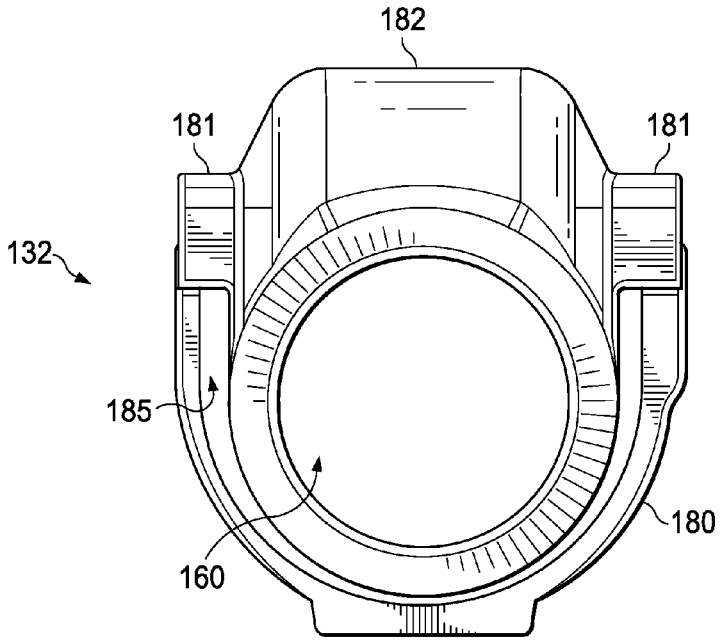
FIG. 20 is a bottom plan view of the shield of FIG. 17.
Figure 21:
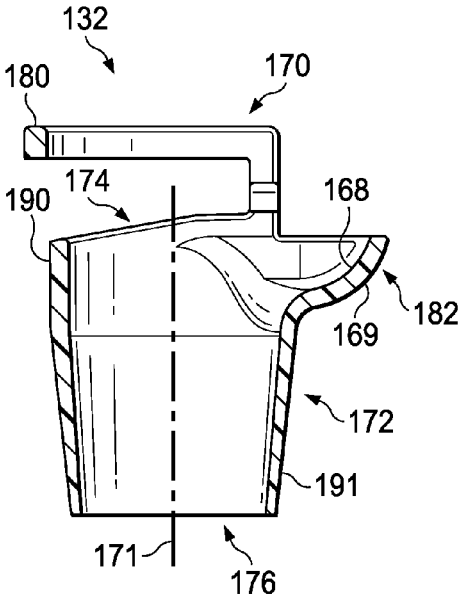
FIG. 21 is a cross-sectional view of the shield of FIG. 17.

Referring to FIGS. 17-21, the shield 132 can include a mount structure 170 and a fluid-deflecting structure 172, which can define an interior flow passage 160. The interior flow passage 160 can have an inlet opening 174 and a discharge opening 176. The discharge opening 176 can be smaller than the inlet opening 174 as shown in FIG. 21. The fluid-deflecting structure 172 can include a frustoconical portion 191, which can define the discharge opening 176. The frustoconical portion 191 can define a longitudinal centerline axis 171 as shown in FIG. 21. The fluid-deflecting structure 172 can generally extend longitudinally, and distally, away from the mount structure 170. The frustoconical portion 191 can generally extend longitudinally, and distally, away from a generally cylindrical portion 190 of the fluid-deflecting structure. The shield 132 can also include a scoop 182, which can facilitate releasably attaching the fluid container assembly to the fluid dispenser. The scoop 182 can extend outwardly away from the mount structure 170 and the fluid-deflecting structure 172. The scoop 182 can include an inner surface 168 and an outer surface 169. The inner surface 168 can be generally concave, and the outer surface 169 can be generally convex, as viewed in cross-section as shown in FIG. 21. In one embodiment, the mount structure 170, the fluid-deflecting structure 172, and the scoop 182 can be integrally formed as a unitary structure. In one embodiment, the mount structure 170, the fluid-deflecting structure 172, and the scoop 182 can be integrally formed from any suitable polymeric material, using any suitable molding process.

Figure 17:
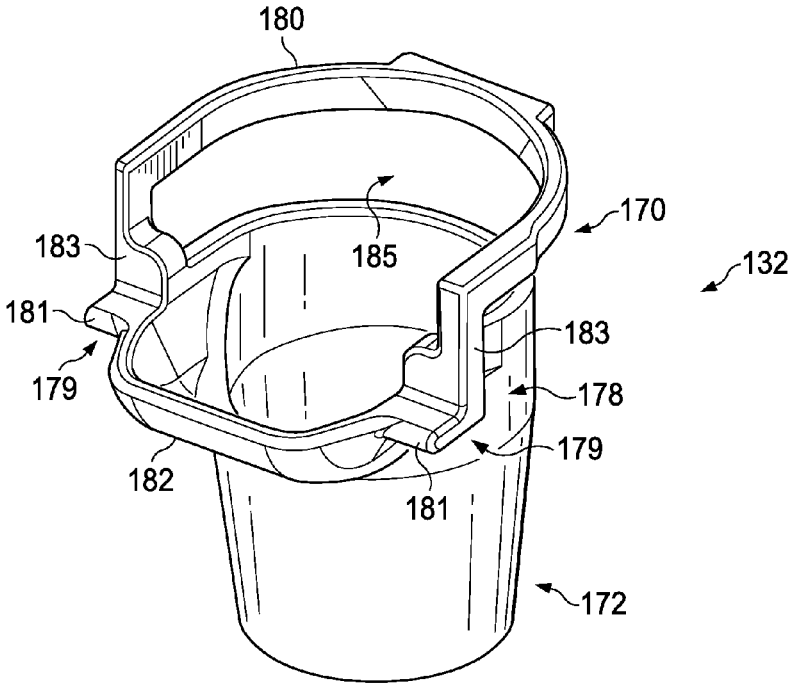
FIG. 17 is a top perspective view of the shield of the fluid dispenser of FIG. 15.
Figure 18:
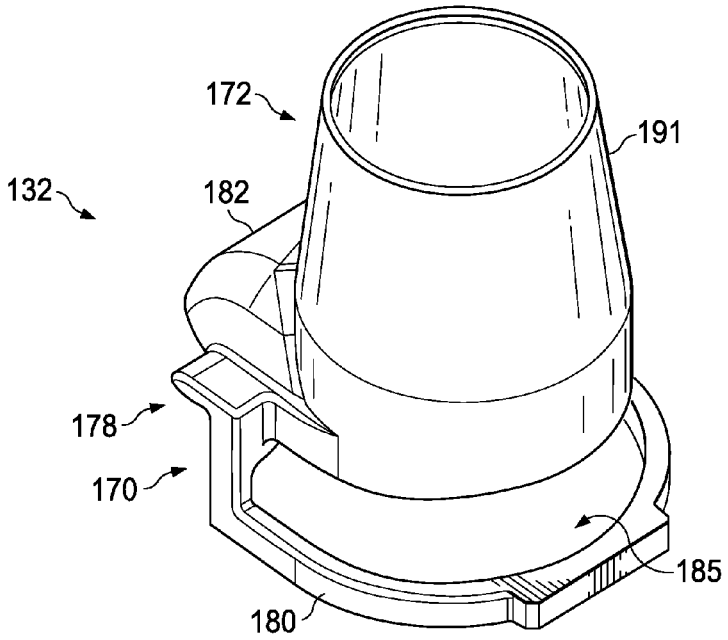
FIG. 18 is a bottom perspective view of the shield of FIG. 17.

The mount structure 170 can include a base 178 and a perimeter flange 180, which can be integral with the base 178. The base 178 can include a pair of base structures 179. One of the base structures 179 can be integral with one side of the scoop 182 and the second one of the base structures 179 can be spaced from the first base structure 179 and integral with an opposite side of the scoop 182, as shown in FIG. 17. Each of the base structures 179 can include a lower portion 181 and an upright portion 183, which can extend proximally away from the lower portion 181.

In one embodiment, the perimeter flange 180 of the mount structure 170 can be generally U-shaped, as shown in FIGS. 17, 19 and 20. A first end of the perimeter flange 180 can be integral with the upright portion 183 of one of the base structures 179 of the base 178 of mount structure 170, and a second end of the perimeter flange 180 can be integral with the upright portion 183 of the other one of the base structures 179. As shown in FIGS. 17-21, the perimeter flange 180 of the mount structure 170 can be spaced proximally and outwardly from the fluid-deflecting structure 172. The perimeter flange 180 and the fluid-deflecting structure 182 can cooperate to define an aperture 185 that can be sized and configured to receive a portion of the actuator 130. As shown in FIG. 16, the perimeter flange 180 can engage a mount portion 188 of the actuator 130 to attach the shield 132 to the actuator 130. In one embodiment, the perimeter flange 180 of shield 132 can be sandwiched between, or clamped by, two portions of the mount portion 188 of the actuator 130 to attach the shield 132 to the actuator 130.

When the shield 132 is attached to the actuator 130, the distal end portion 155 of the nozzle 146 of pump 134 can be positioned proximate to, or within, the interior flow passage 160 defined by the shield 132. As a result, the discharge orifice can be in fluid communication with the interior flow passage 160, and a fluid, e.g., liquid gel, discharging from the discharge orifice during operation of the fluid dispenser system can discharge into the interior flow passage 160. The discharge orifice can be generally centrally aligned with the interior flow passage 160, which can facilitate discharging fluid from the discharge orifice into the interior flow passage 160. In one embodiment, the discharge orifice can be coaxially disposed about longitudinal centerline axis 171 defined by the frustoconical portion 191 of the fluid-deflecting structure 172, and the longitudinal centerline axis 171 can extend through the discharge orifice.

Figure 22:
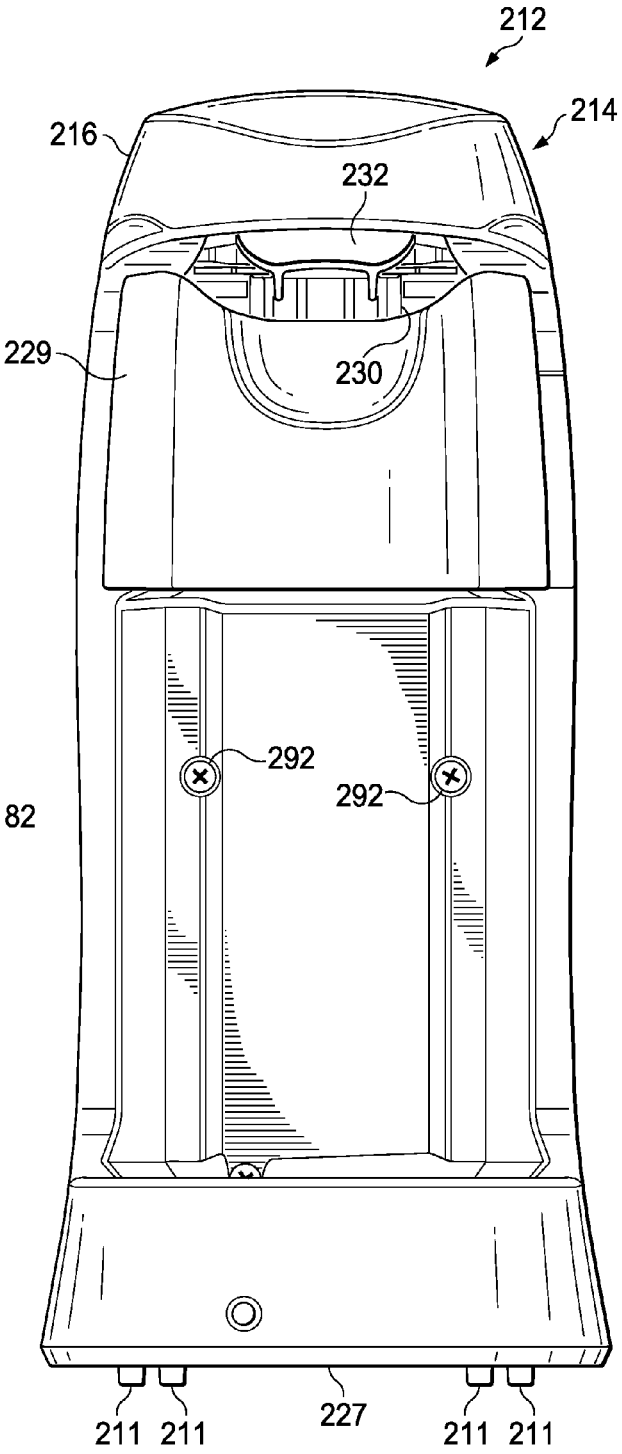
FIG. 22 is a front elevational view depicting a fluid dispenser, according to another embodiment, which includes a shield according to another embodiment.
Figure 23:
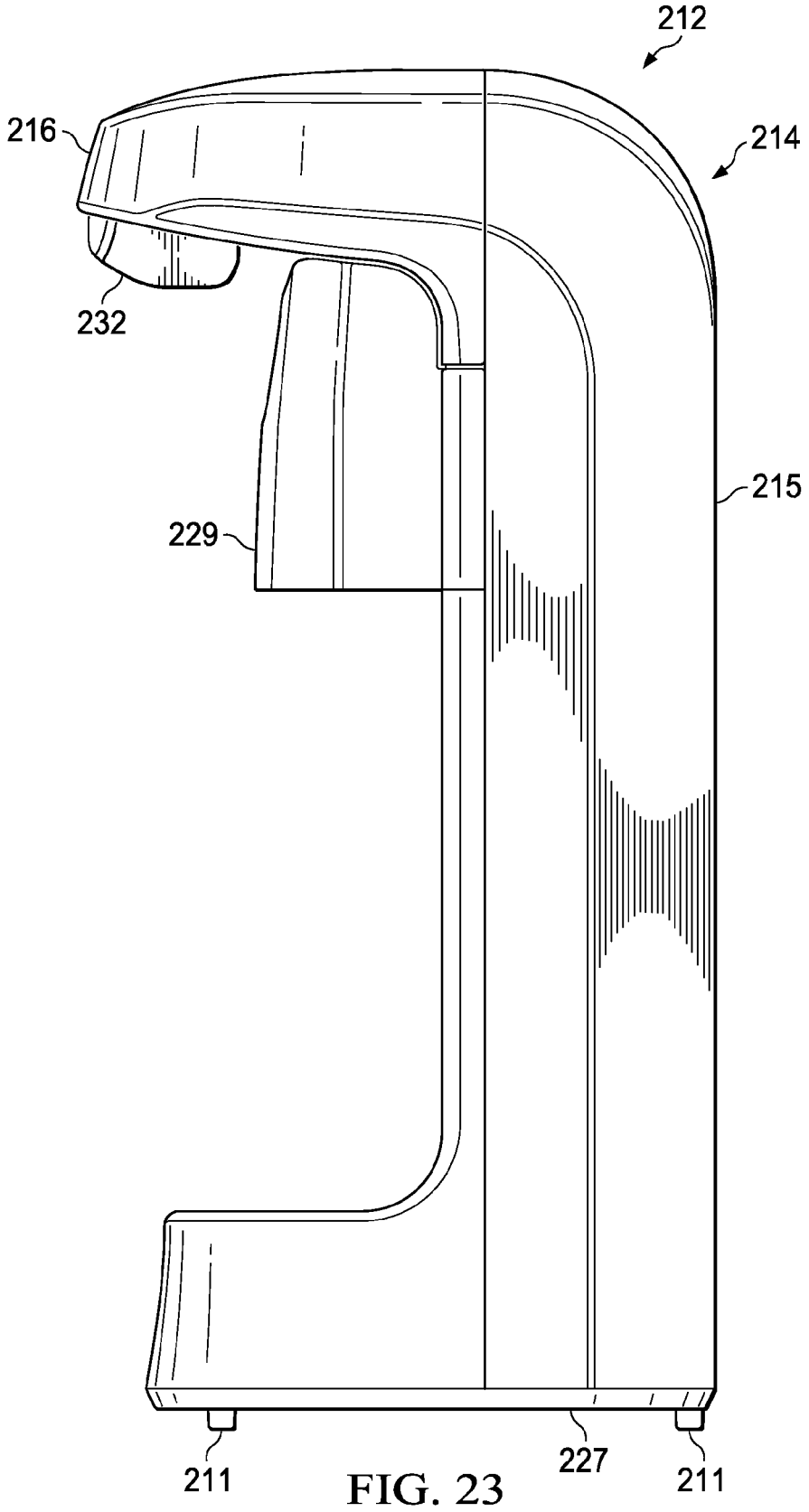
FIG. 23 is a left side elevational view depicting the fluid dispenser of FIG. 22.
Figure 24:
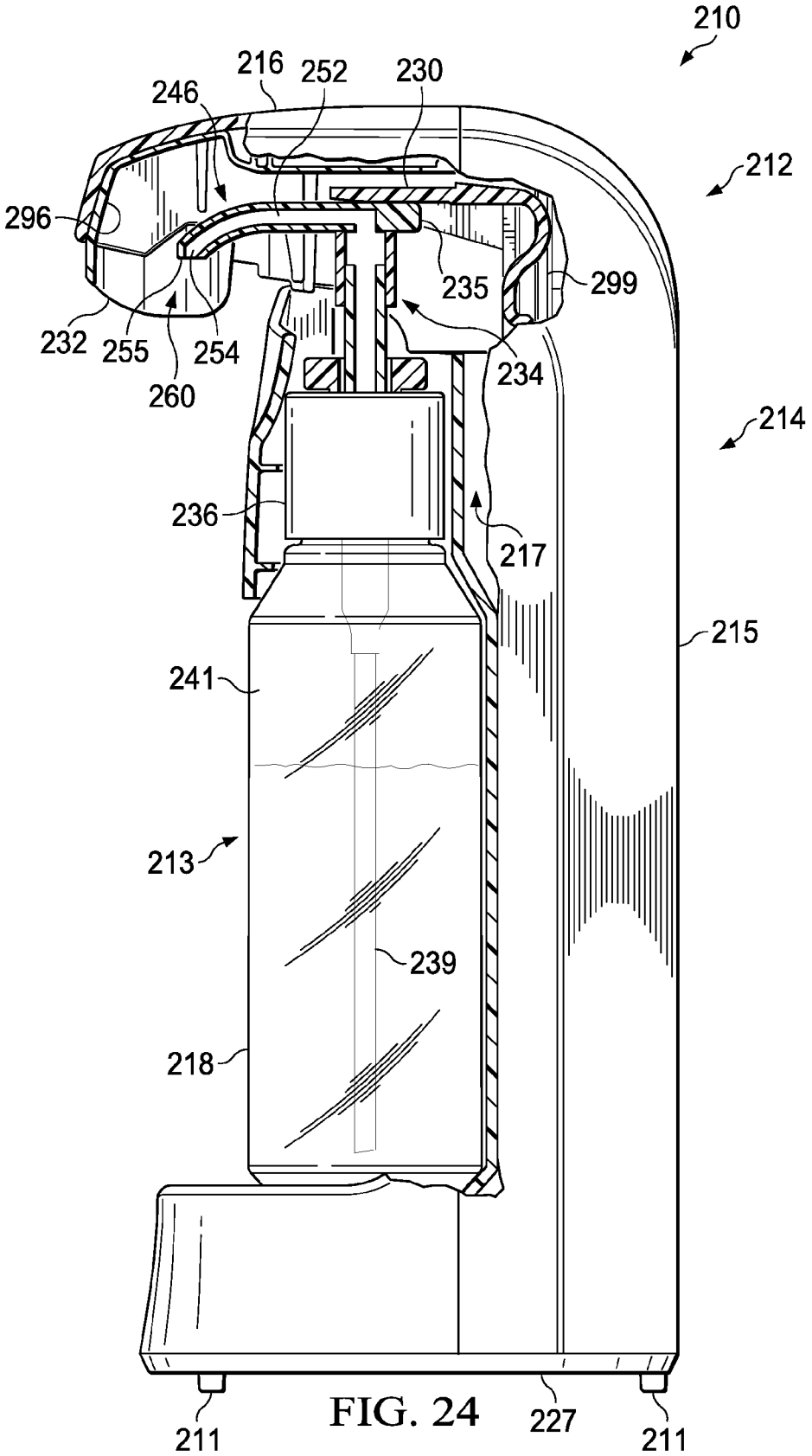
FIG. 24 is a left side elevational view, partially cut away and partially in cross-section, depicting a fluid dispenser system that includes the fluid dispenser of FIG. 22 and a fluid container assembly.

FIGS. 22-26 illustrate a fluid dispenser system 210 according to another embodiment, which can be configured for positioning on a tabletop or other support structure. The fluid dispenser system 210 can include a fluid dispenser 212 and a fluid container assembly 213, which can be supported by the fluid dispenser 212, as shown in FIG. 24. When the fluid dispenser system 210 is positioned, or placed, on a tabletop or other support structure, the fluid dispenser system 210 can be disposed in an upright orientation. The fluid dispenser 212 can include a plurality of feet 211 that can facilitate placing the fluid dispenser system 210 on a support surface.

The fluid dispenser 212 can include a housing 214, which can include a rear housing 215 and a front housing 216 that can be attached to one another, for example using a plurality of fasteners such as male fasteners 292 (FIG. 22). The fluid dispenser 212 can also include a mount plate 299 that can be attached to the housing 214. For example, the mount plate 299 can be fastened to at least one of the rear housing 215 and the front housing 216. The fluid dispenser 212 can further include an actuator 230, which can be slidably coupled with the mount plate 299 such that the actuator 230 can be movable upwardly and downwardly, relative to the mount plate 299, the rear housing 215 and the front housing 216.

A motor (not shown) can be coupled with the actuator 230, e.g., with a drivetrain (not shown), to selectively, operably actuate, or move, the actuator 230, causing fluid, e.g., a liquid gel, to be dispensed from the fluid dispenser system 210. The rear housing 215 and the front housing 216 can cooperate to at least partially define an interior chamber 217 that can house various components of the fluid dispenser 212, which can include the mount plate 299 and the actuator 230. In one embodiment, the fluid dispenser 212 can also include a base 227, which can be secured to at least one of the rear housing 215 and the front housing 216. The feet 211 can be secured to the base 227.

The fluid container assembly 213 can include a fluid container 218 and a pump 234 that can be coupled with the fluid container 218. In one embodiment, the pump 234 can include a closure 236, or cap, which can be threaded onto a neck of the fluid container 218. The pump 234 can also include a plunger 235, and a nozzle 246, which can be integral with, and can extend away from, the plunger 235. The plunger 235 can be movable with respect to the closure 236 and the fluid container 218, and can define a plunger flow passage. The fluid container assembly 213 can also include a dip tube 239, which can be coupled with the pump 234 and can extend into a fluid chamber 241 defined by the fluid container 218. The dip tube 239 can define a dip tube flow passage that can be in fluid communication with each of the fluid chamber 241 defined by the fluid container 218 and the plunger flow passage. The nozzle 246 can define a nozzle flow passage 252 that can be in fluid communication with the plunger flow passage. The nozzle 246 can include a distal end portion 255, which can define a discharge orifice 254. The discharge orifice 254 can be in fluid communication with the nozzle flow passage 252 such that depressing the plunger 235 can result in fluid within the fluid chamber 241 being dispensed through the discharge orifice 254.

The fluid dispenser can include a door 229, which can be pivotally coupled with the housing 214. In one embodiment, the door 229 can be pivotally coupled with the front housing 216 as shown in FIG. 23, for example, using one or more hinges. The door 229 can be pivotable between a closed position, shown in FIGS. 22 and 23, and an open position. The door 229 can be opened to facilitate positioning the fluid container assembly 213 relative to the fluid dispenser 212, and can surround a portion of the fluid container assembly 213 when closed. Referring to FIG. 24, in one embodiment, the door 229 can surround a portion of the pump 234 and a portion of the fluid container 218 when the door 229 is closed.

Figure 25:
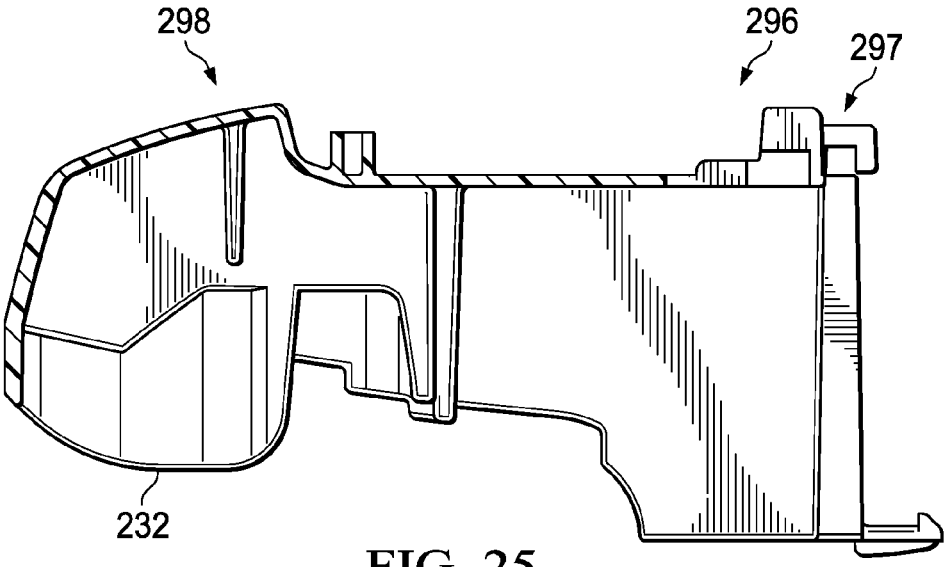
FIG. 25 is a cross-sectional view depicting the shield and a lens support structure of the fluid dispenser of FIG. 22.
Figure 26:
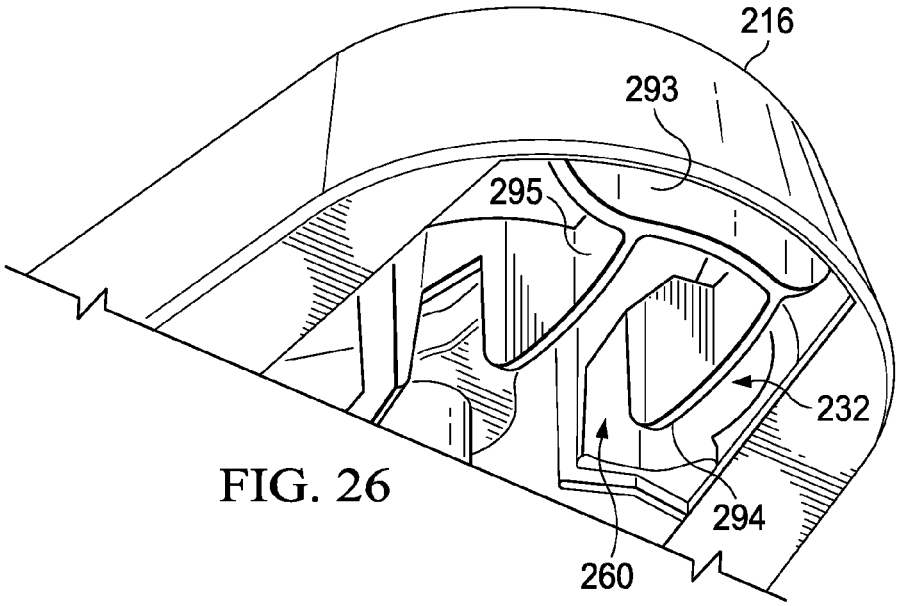
FIG. 26 is a bottom perspective view depicting the shield and a portion of the lens support structure of the fluid dispenser of FIG. 22.

Referring to FIGS. 25 and 26, the shield 232 can include a front portion 293, a first side portion 294, and a second side portion 295 spaced from the first side portion 294. Each of the first side portion 294 and the second side portion 295 can be integral with, and can extend away from, the front portion 293. The front portion 293, the first side portion 294, and the second side portion 295 can cooperate to at least partially define an interior flow passage 260. The fluid dispenser 212 can further include a lens support structure 296 that can be configured to support one or more sensors, such as one or more optical lens, or sensors, which can operably sense the presence of a user's hands below the nozzle 246 of pump 234.

The shield 232 can be fixedly coupled with the housing 214 of the fluid dispenser 212. For example, in one embodiment, the shield 232 can be integrally formed with the lens support structure 296, from any suitable material, as a unitary structure, and the lens support structure 296 can be fixedly coupled with the housing 214 of the fluid dispenser 212, which can prevent translation of the lens support structure 296 and the shield 232 relative to the housing 214. In one embodiment, a proximal end portion 297 of the lens support structure 296 can be secured to at least one of the rear housing 215 and the front housing 216 of the fluid dispenser 212. In other embodiments, the shield 232 can be fixedly coupled with the housing 214 with any other suitable structural configuration or arrangement.

In one embodiment, the shield 232 can be integrally formed with the lens support structure 296 from any suitable polymeric material, using any suitable molding process. In one embodiment, the shield 232 can cooperate with a distal end portion 298 of the lens support structure 296 to define the interior flow passage 260. A rear portion of the interior flow passage 260 can be open such that the nozzle 246 can extend between the first side portion 294 and the second side portion 295 of the shield 232. The distal end portion 255 of the nozzle 246 can be positioned within the interior flow passage 260, such that the discharge orifice 254 defined by the distal end portion 255 of nozzle 246 is in fluid communication with the interior flow passage 260. As shown in FIG. 24, the shield 232 can extend below the distal end portion 255 of the nozzle 246.

Use of the shields 32, 132 and 232 can be advantageous, for example as illustrated by the following description of the operation of the fluid dispenser system 10. The fluid dispenser system 10 can include a sensor (not shown) and suitable electronic components, which can be housed within the interior chamber 17. The electrical components can be electrically coupled with the sensor and with the motor disposed within the motor housing 24, such that, when a user positions his or her hand(s) in proximity to the fluid dispenser system 10, for example below the shield 32, the sensor can cause the motor 25 to be turned on. As a result of the coupling of the cam gear 62 to each of the motor 25 and the actuator 30, the reciprocating piston 44 can move downwardly and upwardly in response to rotation of the cam gear 62, corresponding to a downstroke movement and an upstroke movement, respectively, of the reciprocating piston 44.

When the sensor senses the presence of a user's hand(s), and the reciprocating piston 44 is moving in a downstroke direction, a fluid, such as a liquid gel, can flow from a discharge port of the fluid container 18 into the inlet port 37 of pump 34, around the intake valve 40, and into the piston chamber 42, due to a partial vacuum existing in the piston chamber 42 caused by the downward movement of the reciprocating piston 44. This fluid can then flow around an upper portion of the reciprocating piston 44, for example around an outside portion of wiper valves disposed at an upper end of the reciprocating piston 44, and into the interior flow passage 45 defined by the reciprocating piston 44. The fluid can then flow downwardly through the interior flow passage 45 and into the nozzle flow passage 52 defined by the nozzle 46. The fluid can then discharge from the nozzle 46, through the discharge orifice 54 and into the interior flow passage 60 defined by the shield 32.

In some instances, a portion of the fluid, such as liquid gel, can dry within the nozzle flow passage 52, and/or the discharge orifice 54, which can restrict the discharge orifice 54. This can result in the fluid, such as a liquid gel, or a foam, discharging from the discharge orifice 54 at a relatively high velocity, and in a random direction that is not intended. For example, the dispensed fluid when dispensed can exit at a significant angle away from the longitudinal centerline axis 71 defined by the frustoconical portion 91 of the fluid-deflecting structure 72. Fluid that is dispensed in such a random, unintended direction can be referred to as misdirected dispense. In the absence of shield 32, this misdirected dispense, such as liquid gel, could cause the liquid gel to be dispensed away from a user's hand(s) and either onto another portion of the user's body or onto a floor, or other support structure, of the facility in which the user is standing, which is unintended and undesirable.

The shield 32 can redirect the majority of, or all of, the misdirected dispense, such that the dispensed fluid can be dispensed onto the hands of the user, as intended. For example, the misdirected dispense can contact an inner surface of the fluid-deflecting structure 72, with the misdirected dispense being redirected in a substantially downward direction, i.e., in a direction forming a relatively shallow, or small, angle with the longitudinal centerline axis 71 defined by the frustoconical portion 91 of the fluid-deflecting structure 72. Redirecting the misdirected dispense can be achieved as a result of various factors that can include the spatial relationship between the distal end portion 55 of nozzle 46 and the shield 32, for example, positioning the distal end portion 55 within the interior flow passage 60 defined by the shield 32, and at least substantially surrounding the distal end portion 55 with the shield 32.

The configuration of the frustoconical portion 91 can also facilitate redirecting the misdirected dispense, for example by forming the frustoconical portion 91 such that the inner surface of the frustoconical portion 91 forms a relatively shallow, or small, angle with the longitudinal centerline axis 71 defined by the frustoconical portion 91. The orientation of the discharge orifice 54 defined by the distal end portion 55 of nozzle 46 can also facilitate redirecting the misdirected dispense as desired. For example, in embodiments where the distal end portion 55 is coaxially disposed about the longitudinal centerline axis 71 defined by the frustoconical portion 91, and the longitudinal centerline axis 71 extends through the discharge orifice 54.

The configuration of shield 132 and the spatial relationship between shield 132 and the distal end portion 155 of nozzle 146, as well as the configuration of shield 232 and the spatial relationship between shield 232 and the distal end portion 255 of nozzle 246, can result in similar advantages to those that can be achieved by shield 32.

The foregoing description of embodiments and examples has been presented for purposes of illustration and description, and is not intended to restrict or in any way limit the scope of the present disclosure. Numerous modifications are possible in light of the above teachings. Some of those modifications have been described, and others will be understood by those skilled in the art.

What is claimed is:

1. A fluid dispenser comprising:

a housing configured to support a fluid container and comprising a lid and a base that cooperate to define an interior chamber;

an actuator, the actuator being movable with respect to the housing; and a shield comprising a mount structure and a fluid-deflecting structure, the fluid-deflecting structure defining an interior flow passage having an inlet opening and a discharge opening; wherein:

the mount structure and the fluid-deflecting structure are integrally formed as a unitary structure;

at least a portion of the fluid-deflecting structure of the shield extends out of the interior chamber and through at least one of the lid and the base such that the discharge opening is external to the housing;

the discharge opening is smaller than the inlet opening and is spaced distally from the mount structure;

the mount structure is attached to the actuator such that the shield is movable with the actuator relative to the housing;

the mount structure comprises a base flange and a perimeter flange, the base flange being integral with, and extending outwardly from, the fluid-deflecting structure;

the perimeter flange is integral with, and transverse to, the base flange and extends around at least a portion of the base flange;

the mount structure further comprises a plurality of mount arms integral with, and extending inwardly from, the perimeter flange of the mount structure, the mount arms being spaced from one another;

each of the mount arms is spaced proximally from the base flange and is attached to the actuator; and the fluid-deflecting structure extends downwardly away from the mount structure.

2. The fluid dispenser of claim 1, wherein:

the actuator comprises a perimeter flange; and each of the mount arms comprises a distal tab, each of the distal tabs being engaged with the perimeter flange of the actuator in a snap-fit arrangement.

3. The fluid dispenser of claim 1, further comprising:

a cam gear comprising a pin, the pin being engaged with the actuator; and a motor drivingly coupled with the cam gear, the motor operably, selectively rotating the cam, causing the actuator and the shield to move upwardly and downwardly.

4. The fluid dispenser of claim 3, wherein the lid is pivotally coupled with the base and is pivotable between an open position and a closed position.

5. The fluid dispenser of claim 1, wherein:

at least one of the lid and the base defines a housing opening; and the shield extends through the housing opening such that the discharge opening is beneath the housing opening.

6. The fluid dispenser of claim 5, wherein the discharge opening is a lowermost opening of the fluid dispenser.

7. The fluid dispenser of claim 1, wherein:

the shield further comprises a scoop that extends outwardly away from at least one of the mount structure and the fluid-deflecting structure;

the scoop comprises an inner surface and an outer surface;

the inner surface is concave, and the outer surface is convex, as viewed in cross-section; and the mount structure, the fluid-deflecting structure, and the scoop are integrally formed from as a unitary structure.

8. A fluid dispenser comprising:

a housing configured to support a fluid container and comprising a lid and a base that cooperate to define an interior chamber;

an actuator, the actuator being movable with respect to the housing; and a shield comprising a mount structure and a fluid-deflecting structure, the fluid-deflecting structure defining an interior flow passage having an inlet opening and a discharge opening; wherein:

the mount structure and the fluid-deflecting structure are integrally formed as a unitary structure;

at least a portion of the fluid-deflecting structure of the shield extends out of the interior chamber and through at least one of the lid and the base such that the discharge opening is external to the housing;

the discharge opening is smaller than the inlet opening and is spaced distally from the mount structure;

the mount structure is attached to the actuator such that the shield is movable with the actuator relative to the housing;

the mount structure comprises a base flange and a perimeter flange integral with the base flange;

the perimeter flange of the mount structure is spaced proximally and outwardly from the fluid-deflecting structure;

the perimeter flange of the mount structure, and the fluid-deflecting structure, cooperate to define a mount aperture; and the mount aperture receives a portion of the actuator.

9. A fluid dispenser system comprising:

a fluid container assembly comprising:

a housing comprising a lid and a base that cooperate to define an interior chamber;

an actuator, the actuator being movable with respect to the housing; and a shield comprising a mount structure and a fluid-deflecting structure, the shield being coupled with the housing and the fluid-deflecting structure defining an interior flow passage having an inlet opening and a discharge opening; and a fluid dispenser comprising:

a fluid container that is supported by the housing and is configured to contain a fluid for dispensing therefrom; and a pump, the pump comprising a nozzle; wherein:

the mount structure and the fluid-deflecting structure are integrally formed as a unitary structure;

the nozzle defines a nozzle flow passage and comprises a distal end portion, the distal end portion of the nozzle defining a discharge orifice in fluid communication with the nozzle flow passage;

at least a portion of the actuator within the shield selectively actuates the pump;

the shield at least partially defines an interior flow passage, the distal end portion of the nozzle being positioned at least partially within the interior flow passage defined by the shield, the discharge orifice defined by the distal end portion of the nozzle being in fluid communication with the interior flow passage defined by the shield; and at least a portion of the shield extends out of the interior chamber and through at least one of the lid and the base such that the discharge opening is external to the housing.

10. The fluid dispenser system of claim 9, wherein:
the shield is movably coupled with the housing of the dispenser.

11. The fluid dispenser system of claim 10, wherein:
the shield of the fluid dispenser comprises a mount structure attached to the actuator of the fluid dispenser; and
the discharge opening is smaller than the inlet opening and is spaced distally from the mount structure.

12. The fluid dispenser system of claim 11, wherein:
the shield further comprises a fluid-deflecting structure comprising a frustoconical portion;
the fluid-deflecting structure extends distally away from the mount structure and defines the interior flow passage; and
the frustoconical portion defines the discharge opening of the interior flow passage.

13. The fluid dispenser system of claim 12, wherein:
the mount structure comprises a base flange and a perimeter flange integral with the base flange;
the perimeter flange is spaced proximally and outwardly from the fluid-deflecting structure; and
the perimeter flange and the fluid-deflecting structure cooperate to define a mount aperture, the mount aperture receiving a portion of the actuator.

14. The fluid dispenser system of claim 12, wherein:
the frustoconical portion of the fluid deflecting structure defines a longitudinal centerline axis, the distal end of the nozzle being coaxially disposed about the longitudinal centerline axis.

15. The fluid dispenser system of claim 12, wherein:
the mount structure of the shield comprises a base flange and a perimeter flange, the perimeter flange being integral with the base flange and extending around at least a portion of the base flange;
the mount structure further comprises a plurality of mount arms integral with, and extending inwardly from, the perimeter flange, the mount arms being spaced from one another; and
each of the mount arms of the mount structure is spaced proximally from the mount structure and is attached to the actuator.

16. The fluid dispenser system of claim 15, wherein:
the fluid-deflecting structure further comprises a cylindrical portion positioned between the mount structure and the frustoconical portion of the fluid-deflecting structure, the cylindrical portion of the fluid-deflecting structure being integral with each of the mount structure and the frustoconical portion of the fluid-deflecting structure; and
each of the mount arms of the mount structure comprises a distal tab, each of the distal tabs being secured to the actuator.

17. The fluid dispenser system of claim 9, wherein:
the shield of the fluid dispenser is fixedly coupled with the housing of the fluid dispenser; and
the shield comprises a front portion, a first side portion and a second side portion spaced from the first side portion, each of the first side portion and the second side portion being integral with, and extending away from, the front portion.

18. The fluid dispenser system of claim 17, wherein:
the fluid dispenser further comprises a lens support structure, the lens support structure being fixedly coupled with the housing of the fluid dispenser; and
the lens support structure and the shield being integrally formed from a polymeric material as a unitary construction.

19. The fluid dispenser system of claim 9, wherein:
at least one of the lid and the base defines a housing opening; and
the shield extends through the housing opening such that the discharge opening is beneath the housing opening.

20. The fluid dispenser system of claim 19, wherein the discharge opening is a lowermost opening of the fluid container assembly.

21. The fluid dispenser system of claim 9 wherein:
the shield further comprises a scoop that extends outwardly away from at least one of the mount structure and the fluid-deflecting structure;
the scoop comprises an inner surface and an outer surface;
the inner surface is concave, and the outer surface is convex, as viewed in cross-section; and
the mount structure, the fluid-deflecting structure, and the scoop are integrally formed from as a unitary structure.

22. A fluid dispenser system comprising:
a fluid container assembly comprising:
a housing comprising a lid and a base that cooperate to define an interior chamber;
an actuator, the actuator being movable with respect to the housing; and
a shield comprising a mount structure and a fluid-deflecting structure, the shield being coupled with the housing and the fluid-deflecting structure defining an interior flow passage having an inlet opening and a discharge opening; and
a fluid dispenser comprising:
a fluid container that is supported by the housing and is configured to contain a fluid for dispensing therefrom; and
a pump, the pump comprising a nozzle; wherein:
the nozzle defines a nozzle flow passage and comprises a distal end portion, the distal end portion of the nozzle defining a discharge orifice in fluid communication with the nozzle flow passage;
at least a portion of the actuator within the shield selectively actuates the pump;
the shield at least partially defines an interior flow passage, the distal end portion of the nozzle being positioned at least partially within the interior flow passage defined by the shield, the discharge orifice defined by the distal end portion of the nozzle being in fluid communication with the interior flow passage defined by the shield; and
the shield is spaced from the pump when the fluid container is installed in the fluid container assembly.

23. The fluid dispenser system of claim 22 wherein at least a portion of the shield extends out of the interior chamber and through at least one of the lid and the base such that the discharge opening is external to the housing.

24. The fluid dispenser system of claim 23, wherein:
at least one of the lid and the base defines a housing opening;
the shield extends through the housing opening such that the discharge opening is beneath the housing opening; and
the discharge opening is a lowermost opening of the fluid container assembly.

* * * * *